US010369565B2

(12) United States Patent
Fischer

(10) Patent No.: US 10,369,565 B2
(45) Date of Patent: Aug. 6, 2019

(54) DIGITAL MICROFLUIDIC DILUTION APPARATUS, SYSTEMS, AND RELATED METHODS

(71) Applicant: Abbott Laboratories, Abbott Park, IL (US)

(72) Inventor: Andrew Fischer, Euless, TX (US)

(73) Assignee: Abbott Laboratories, Abbott Park, IL (US)

( * ) Notice: Subject to any disclaimer, the term of this patent is extended or adjusted under 35 U.S.C. 154(b) by 719 days.

(21) Appl. No.: 14/976,684

(22) Filed: Dec. 21, 2015

(65) Prior Publication Data

US 2016/0184823 A1 Jun. 30, 2016

Related U.S. Application Data

(60) Provisional application No. 62/098,679, filed on Dec. 31, 2014.

(51) Int. Cl.
*B01L 3/00* (2006.01)

(52) U.S. Cl.
CPC ... *B01L 3/502707* (2013.01); *B01L 3/502792* (2013.01); *B01L 2300/0645* (2013.01); (Continued)

(58) Field of Classification Search
CPC ..... B01L 3/502707; B01L 3/502792; B01L 2300/089; B01L 2300/0861; B01L 2300/0645; B01L 2400/0427
See application file for complete search history.

(56) References Cited

U.S. PATENT DOCUMENTS 5,512,489 A 4/1996 Girault et al.
5,575,930 A 11/1996 Tietje-Girault et al.
(Continued)

FOREIGN PATENT DOCUMENTS

EP 0480703 3/1997
EP 1487605 12/2007
(Continued)

OTHER PUBLICATIONS

International Searching Authority, "Written Opinion and Search Report," issued in connection with application No. PCT/US15/67021 dated Jun. 17, 2016, 21 pages.
(Continued)

*Primary Examiner* — J. Christopher Ball
(74) *Attorney, Agent, or Firm* — Hanley, Flight and Zimmerman, LLC

(57) ABSTRACT

Example methods, apparatus, systems for diluting samples are disclosed. An example method includes depositing a first fluid droplet on a first electrode of a plurality of electrodes. The first electrode has a first area. The first fluid droplet has a first volume associated with the first area. The example method includes depositing a second fluid droplet on a second electrode of the plurality of electrodes. The second electrode has a second area. The second fluid droplet has a second volume associated with the second area. The second volume is different than the first volume. The example method includes forming a combined droplet by selectively activating at least one of the first electrode or the second electrode to cause one of the first fluid droplet or the second fluid droplet to merge with the other of the first fluid droplet or the second fluid droplet.

16 Claims, 8 Drawing Sheets

(52) U.S. Cl.
CPC . *B01L 2300/089* (2013.01); *B01L 2300/0861* (2013.01); *B01L 2400/0427* (2013.01)

(56) References Cited

U.S. PATENT DOCUMENTS

| | | | | |
|---|---|---|---|---|
| 6,662,439 | B1 | 12/2003 | Bhullar | |
| 6,803,019 | B1 | 10/2004 | Bjornson et al. | |
| 8,088,578 | B2 | 1/2012 | Hua et al. | |
| 8,178,028 | B2 | 5/2012 | Gandhi | |
| 8,448,530 | B2 | 5/2013 | Leuenberger et al. | |
| 2002/0027634 | A1 | 3/2002 | Kang et al. | |
| 2005/0106507 | A1 | 5/2005 | Bernds et al. | |
| 2006/0280912 | A1 | 12/2006 | Liang et al. | |
| 2008/0128397 | A1 | 6/2008 | Gandhi | |
| 2009/0053859 | A1 | 2/2009 | Xu et al. | |
| 2009/0304944 | A1 | 12/2009 | Sudarsan et al. | |
| 2010/0096266 | A1 | 4/2010 | Kim et al. | |
| 2010/0101700 | A1 | 4/2010 | Liang et al. | |
| 2010/0270156 | A1 | 10/2010 | Srinivasan et al. | |
| 2010/0307917 | A1 | 12/2010 | Srinivasan et al. | |
| 2011/0095201 | A1 | 4/2011 | Stolowitz | |
| 2011/0220505 | A1* | 9/2011 | Wang | B01L 3/502792 204/547 |
| 2011/0266151 | A1 | 11/2011 | Jansson | |
| 2012/0044299 | A1 | 2/2012 | Winger | |
| 2013/0018611 | A1 | 1/2013 | Sturmer | |
| 2013/0217103 | A1 | 8/2013 | Bauer | |
| 2014/0008222 | A1 | 1/2014 | Srinivasan et al. | |
| 2014/0014517 | A1 | 1/2014 | Srinivasan et al. | |
| 2014/0083747 | A1 | 3/2014 | Matsuno et al. | |
| 2015/0174578 | A1 | 6/2015 | Srinivasan et al. | |
| 2015/0298124 | A1 | 10/2015 | Fischer et al. | |

FOREIGN PATENT DOCUMENTS

| | | |
|---|---|---|
| JP | 2006329899 | 12/2006 |
| JP | 2011508224 | 3/2011 |
| WO | 03088724 | 10/2003 |
| WO | 2005019875 | 3/2005 |
| WO | 2006129486 | 12/2006 |
| WO | 2008091848 | 7/2008 |
| WO | 2009076414 | 6/2009 |
| WO | 2009086403 | 7/2009 |
| WO | 2011002957 | 1/2011 |
| WO | 2011126892 | 10/2011 |
| WO | 2012012090 | 1/2012 |

OTHER PUBLICATIONS

International Bureau, "International Preliminary Report on Patentability," issued in connection with international patent application No. PCT/US2015/067021, dated Jul. 4, 2017, 13 pages.
Patent Cooperation Treaty, "Invitation to Pay Additional Fees," issued in connection with application No. PCT/US2015/067021, dated Apr. 11, 2016, 9 pages.
Bitman, et al., "Production Considerations for Bistable Droplet Driven Electrowetting Displays," SID Symposium Digest of Technical Papers, 43(1), (Jun. 2012), pp. 846-849, Abstract provided, 2 pages.
Chen, et al., "Technology Advances in Flexible Displays and Substrates," IEEE Access, 1 (2013), pp. 150-158, 9 pages.
Fair, "Digital Microfluidics: Is a True Lab-on-a-Chip Possible?" Microfluid Nanofluid, vol. 3 (2007), pp. 245-281, 37 pages.
Fair, et al., "Electrowetting-Based On-Chip Sample Processing for Integrated Microfluidics," published in Technical Digest, IEEE International Electron Devices Meeting (Dec. 8-10, 2003, Washington DC); 4 pages (also available at http://ieeexplore.ieee.org/xpl/login.jsp?tp=&arnumber=1269396&url=http%3A%2F%2Fieeexplore.ieee.org%2Fxpls%2Fabs_all.jsp%3Farnumber%3D1269396).
Gu, et al., "A Hybrid Microfludic Chip with Electrowetting Functionality Using Ultraviolet (UV)-Curable Polymer," Lab on a Chip, vol. 10, (2010), pp. 1150-1156, 7 pages.
Herbst, et al., "High Power Excimer Laser Micromachining," Proceedings of the SPIE, 6106, (2006), Abstract provided, 1 page.
Hu, et al., "Flash Dry Deposition of Nanoscale Material Thin Films," Journal of Materials Chemistry, vol. 19(32), (2009), pp. 5845-5849, Abstract provided, 3 pages.
Kasbashin, et al., "Laser Ablation-Based Nanofabrication in Aqueous Solutions," Materials Research Society Proceedings, vol. 850 (2004), Abstract provided, 1 page.
Le, et al., "Audible OLED Device on Flexible PVDF Substrate with Laser Patterned ITO Electrode," 2008 SID International Symposium, vol. 39(3), (2008), Abstract provided, 1 page.
Lo, et al., "Micro Roll-to-Roll Patterning Process and Its Application on Flexible Display," Japanese Journal of Applied Physics, vol. 48(6S), (2009), Abstract provided, 2 pages.
Lo, et al, "Novel Roll-to-Roll Lift-Off Patterned Active Matrix Display on Flexible Polymer Substrate," Microelectronic Engineering, vol. 86(4-6) (Apr.-Jun. 2009), pp. 979-983, Abstract provided, 1 page.
Wagner, "Scanning Excimer Laser Ablation of Poly(Ethylene Terephthalate) (PET) and its Application to Rapid Prototyping of Channels for Microfluidics,", Thesis, Ecole Polytechnique Federale de Lausanne, (2000), 149 pages (with English translation).
Walker, "Fabrication of Microfluidic Structures by Laser Ablation and Automation of Optical Testing," Thesis, California Institute of Technology, Pasadena, California, (2010),119 pages.
Wang, et al., "Microfludic Actuation of Insulating Liquid Droplets in a Parallel-Plate Device," Journal of Physics: Conference Series 301, 13th International Conference on Electrostatics (2011), 4 pages.
Watson, et al., "Multilayer Hybrid Microfludics: A Digital-to-Channel Interface for Sample Processing and Separations," Analytical Chemistry, vol. 82, No. 15 (2010), pp. 6680-6686, 7 pages.
Zhai, et al.,"Pulsed Electron Deposition for Coated Conductor Applications," Frontiers in Superconducting Materials: New Materials and Applications, 2003 Materials Research Society Meeting, EXS(3) (2004), Abstract provided, 1 page.
Japanese Patent Office, "Office action," issued in connection with Japanese Application No. 2017-534963, dated May 22, 2018, 11 pages (includes English translation).
Canadian Patent Office, "Examination Search Report," issued in connection with Application No. 2,972,577, dated Jul. 13, 2018, 4 pages.
The State Intellectual Property Office of People's Republic of China, "First Office Action," issued in connection with Chinese Application No. 201580077138.4, dated Feb. 1, 2019, 8 pages. (English Translation Included.).
Japanese Patent Office, "Examiner's Decision of Rejection," issued in connection with Japanese Application No. 2017-534963, dated May 14, 2019, 7 pages. (English Translation Included).

* cited by examiner 500
501
515
518
502
504
508
506
522
510
514
512
520
516

526
501
515
504
508
506
510
502
524

322
ANALYZER

DIGITAL MICROFLUIDIC DILUTION APPARATUS, SYSTEMS, AND RELATED METHODS

RELATED APPLICATIONS

This patent claims the benefit under 35 U.S.C. § 119(e) to U.S. Provisional Patent Application No. 62/098,679, filed Dec. 31, 2014, which is hereby incorporated by reference in its entirety.

FIELD OF THE DISCLOSURE

This disclosure relates generally to electrode arrays and, more particularly, to digital microfluidic dilution apparatus, systems, and related methods.

BACKGROUND

Analytical devices often require dilution of samples, such as biological fluids, within certain concentration levels based on an analytical sensitivity range for a device. Digital microfluidics allows for manipulation of discrete volumes of fluids, including electrically moving, mixing, and splitting droplets of fluid disposed in a gap between two surfaces, at least one of the surfaces of which includes an electrode array coated with a hydrophobic and/or a dielectric material. Dilutions performed using a digital microfluidic device are typically serial dilutions, which involve merging sample droplets with diluent droplets having a substantially equal volumes and splitting the combined droplet to achieve a dilution ratio. Serial dilutions often create droplets that are large and difficult to manipulate, thereby increasing imprecisions during the dilution process. Serial dilutions are also limited with respect to dilution ratios that can be achieved and require repetitive steps of merging and splitting droplets to obtain a target dilution ratio.

DETAILED DESCRIPTION

Methods, systems, and apparatus involving dilution of samples using digital microfluidic devices are disclosed herein. Analytical devices, such as those used for immunoassay analysis, typically have a sensitivity range, which represents the smallest amount of a substance in a sample that can accurately be measured by an assay. An analytical device's sensitivity range often requires samples analyzed using the device, including, for example, biological fluid samples such as blood, plasma, serum, saliva, sweat, etc., to be diluted to meet concentration targets that fall within the sensitivity range. For example, 10 microliters (μL) of a sample may be required to be diluted with 200 μL of diluent for a dilution ratio of 0.05 (10/(10+200)), or approximately a 20× dilution.

Figure 1:
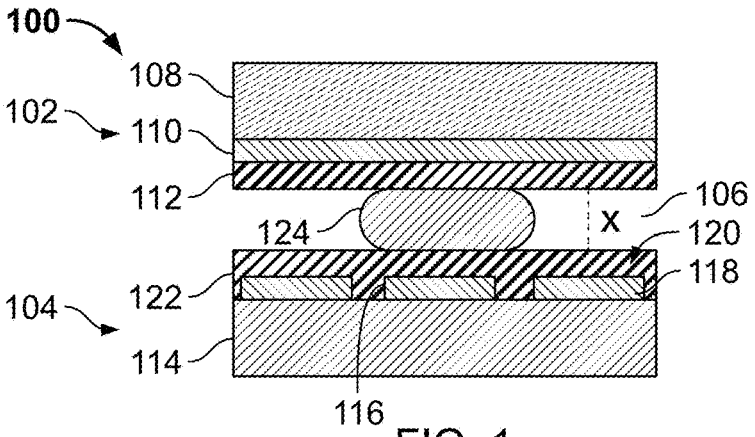
FIG. 1 Prior Art
FIG. 1 is a side view of an example digital microfluidic chip known in the prior art.

Digital microfluidics, or droplet-based analysis, provides for the electrical manipulation of droplets to split, merge, and/or transfer the droplets as part of a variety of analyses including, for example, DNA sequencing and protein analysis. A digital microfluidic device may include two surfaces separated by a gap for receiving a droplet. At least one of the surfaces includes an electrode array that is coated or insulated by a hydrophobic material or a dielectric. FIG. 1 shows an example digital microfluidic chip or droplet actuator 100 known in the prior art including a first, or top, substrate 102 and a second, or base, substrate 104. The base substrate 104 is separated from the top substrate 102 to form a gap 106 having a height x. In the example microfluidic chip 100, the top substrate 102 includes a first non-conductive substrate 108 (e.g., a plastic) and a second conductive substrate 110 (e.g., a metal such as gold or a non-metallic conductor). In some examples, the second conductive substrate 110 forms a single electrode (e.g., a ground electrode). A hydrophobic and/or a dielectric material coats the second conductive substrate 110 to form a first hydrophobic and/or a dielectric layer 112. In other examples, the digital microfluidic chip 100 does not include a top substrate 102.

In the example digital microfluidic chip 100, the base substrate 104 includes a second non-conductive substrate 114 and at least one electrode 116 formed from a conductive substrate 118. The at least one electrode 116 forms an electrode array 120. A hydrophobic and/or a dielectric material coats the electrode array 118 to form a second hydrophobic and/or a dielectric layer 122. A droplet 124 disposed in the gap 106 can be manipulated on the surface of the hydrophobic and/or dielectric layers 112, 120 by selectively applying electrical potentials to electrodes (e.g., the electrode(s) 116 of the electrode array 118) via an electrical source (e.g., a voltage source) to affect the wetting properties of the hydrophobic and/or dielectric surface pursuant to, for example, electrowetting or dielectrophoresis processes.

The volume of the droplet 124 disposed in the digital microfluidic device 100 is determined by the height x of the gap 106 and an area of the electrode(s) 116 within the electrode array 118 patterned on the first base substrate 104. Activation of the electrode(s) 116 via application of electrical potentials causes the sample fluid of the droplet 106 to overlay the activated electrode as a result of changes to the wetting properties of a hydrophobic surface coating the electrode array via electrowetting and/or changes to forces exerted on a dielectric surface coating the electrode area as part of dielectrophoresis. Because the gap height x of the digital microfluidic chip 100 remains constant, the volume of the droplet 122 disposed within the gap 106 is dependent on the area of the electrode(s) 116 of the electrode array 118.

Figure 2:
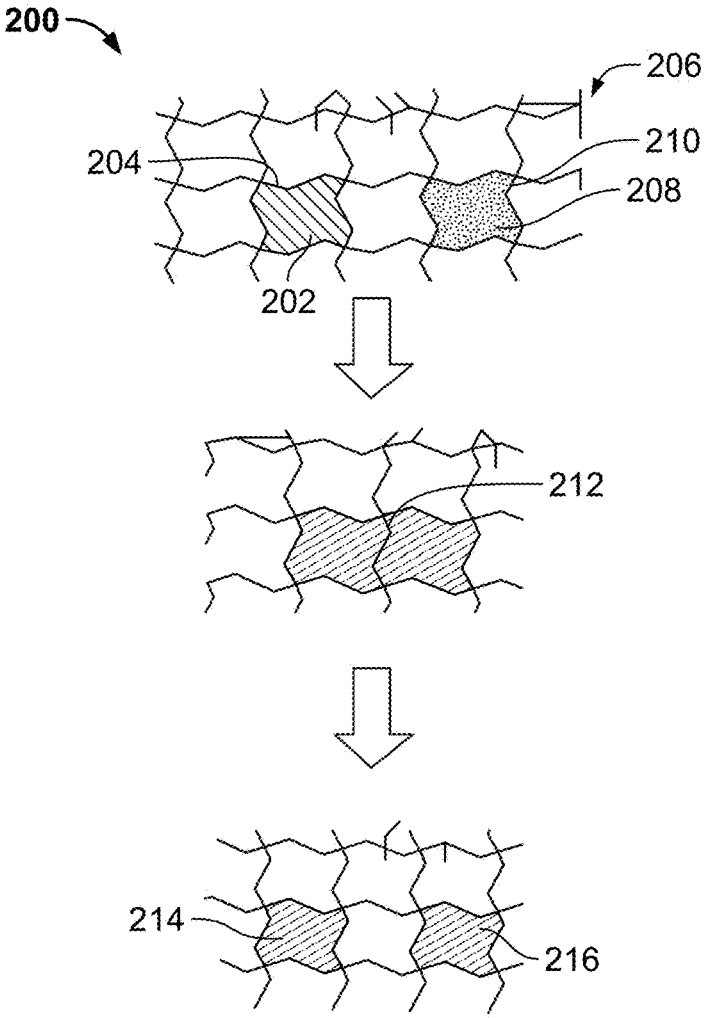
FIG. 2 Prior Art
FIG. 2 is a diagram of an example serial dilution process known in the prior art.

The manipulation of droplets using digital microfluidics can be employed as part of a dilution process for diluting a sample within a certain concentration range. Known methods and systems for diluting samples using digital microfluidics involve serial dilutions, in which a sample droplet is repeatedly merged with a diluent droplet having a substantially equal volume and split (e.g., via manipulation of the droplet on a hydrophobic and/or dielectric surface covering an electrode array) to obtain a droplet having a specified dilution ratio. Serial dilutions require repetitive sequences of merging and splitting droplets to obtain a dilution factor (e.g., a final volume over a diluent volume). For example, to obtain a dilution factor of 8, the merging and splitting process must be performed 3 times. For example, FIG. 2 is a diagram of a known serial dilution process 200 using for example, the digital microfluidic chip 100 of FIG. 1. In the serial dilution process 200, a sample droplet 202 is disposed on a first electrode 204 of an electrode array 206. A diluent droplet 208 is disposed on a second electrode 210 of the electrode array 206. In FIG. 2, the first electrode 204 and the second electrode 210 have substantially the same area. Thus, assuming a constant height of the gap (e.g., the gap 106 of FIG. 1) in which the sample droplet 202 and the diluent droplet 208 are disposed, the sample droplet 202 and the diluent droplet 208 have substantially the same volume.

As shown in FIG. 2, the serial dilution process 200 includes merging the sample droplet 202 and the diluent droplet 208 by, for example, applying an electrical potential to the first electrode 204 and the second electrode 210 to move the droplets 202, 208. Merging the droplets 202, 208 forms a first diluted droplet 212 having a sample concentration of half of the sample droplet 202. To achieve further dilution ratios, the serial dilution process 200 includes splitting the first diluted droplet 212 (e.g., by selectively activating one or more electrodes of the electrode array 206) to form second and third diluted droplets 214, 216. The second and third diluted droplets 214, 216 can be merged with additional diluent droplets and spilt to obtain a target concentration for the sample.

The repetitive merging of the sample droplet with a diluent droplet creates a large droplet that is often difficult to manipulate within the digital microfluidic chip and does not easily lend itself to efficient mixing of the sample and the diluent. Further, serial dilutions often lead to the propagation of errors throughout the dilution process. For example, if the combined sample/diluent droplet is not spilt evenly in half at a first sequence, the sample-to-diluent ratio will be skewed in the droplets resulting after the spilt. Merging these droplets with additional amounts of diluent and further splitting of the droplets will magnify errors in the sample-to-dilution ratio as the serial dilution sequence is continued. Changes to the surface areas of the droplets due to surface tension effects during electrical manipulation of the droplets can further contribute to imprecise dilution profiles.

Serial dilutions are also limited with respect to the dilution ratios that can be achieved. For example, serial dilutions can only be achieved by a factor of $2^n$, where n is the number of time the droplet must merged with the diluent and split (e.g., to obtain a dilution factor of 4, two sequences of merging the sample droplet with diluent and splitting the droplet is required). Therefore, serial dilutions are not able to achieve dilution factors of, for example, 3, 5, 6, etc. Further, only dilution factors that are integers can be achieved using serial dilutions.

Disclosed herein are methods and systems for creating electrodes having surface areas that are a fraction of a unit electrode based on a binary sequence. An example binary system disclosed herein relates to the progression of the powers of the number two (e.g., $2^1$, $2^2$, $2^3$, $2^4$, $2^5$ . . . $2^n$). The example systems disclosed herein also begin with the number one and reflect the progression of the number one being doubled such that the binary system is the 1, 2, 4, 8, 16, 32, 64 . . . n . . . series. Creating the electrodes disclosed herein involves patterning electrodes within an electrode array having a substantially uniform area, such that a first, or standard unit electrode, may be represented as having an electrode size of "1" in a binary sequence computed based on a mathematical function, such as $2^n$, where n=0. In the example binary sequence $2^n$, where the range of n is from n=0 to n=6 and assuming a constant gap height, the unit electrode is assigned a relative volume of 64 (i.e., a droplet deposited on the unit electrode is considered to have a relative volume of 64 in view of the constant gap height and the relative area of the unit electrode). In this example, subsequent electrodes are patterned having areas that are fractions of the area of the unit electrode. For example, an electrode represented as "2" in the binary sequence (e.g., $2^1$) would have an electrode size of ½ and a volume of 32 relative to the unit electrode (i.e., a droplet deposited on the electrode is considered to have a relative volume of 32 in view of the constant gap height and the electrode size). Thus, in the example methods and systems disclosed herein, electrodes are created based on fractions of the area of the unit electrode, which provides associated relative volumes of droplets disposed on the electrodes.

Also disclosed herein are example methods and systems for diluting samples using the electrodes patterned based on the binary sequence. Using the differently sized electrodes, sample droplets and diluent droplets associated with the differently sized electrodes can be selectively merged to obtain a combination of sample and diluent droplets that results in a specified dilution ratio. By selectively activating certain electrodes having fractional areas relative to the unit electrode, and thus, corresponding relative volumes, a variety of dilution ratios can be achieved. Dilution ratios created using the methods and systems disclosed herein are not limited to certain integers, factors of integers, etc., but instead can include any dilution ratio possible from the combination of relative volumes associated with the differently sized electrodes. Further, rather than serially increasing the volumes of the droplets and splitting the droplets, dilutions performed using the disclosed example methods involve collecting a droplet from an activated electrode, the droplet being selectively pinched off or partitioned from a larger volume of sample or diluent. Collecting the pinched-off droplet, rather than repeatedly merging and splitting droplets reduces surface tension effects and increases efficiency and precision as compared to serial dilutions. For example, in serial dilutions, splitting a first droplet to obtain a second droplet having a ratio of 80% diluent and 20% sample fluid can result in the second droplet having, for example, a ratio of 75% diluent and 25% sample fluid because of the inexact nature of splitting droplets (e.g., an inability to verify the exactness of the division of the first droplet based on diluent and sample fluid volumes). Conversely, collecting pinched-off portions of diluent and sample fluids as disclosed herein provides for a droplet having a more precise dilution ratio, as pinched-off portions with associated volumes are selectively collected to build a diluted droplet and, thus, opportunities for inexactitudes are substantially eliminated as compared to splitting droplets.

An example method disclosed herein for diluting a fluid includes depositing a first fluid droplet on a first electrode of a plurality of electrodes. The first electrode has a first area. The first fluid droplet has a first volume associated with the first area. The example method includes depositing a second fluid droplet different from the first fluid droplet on a second electrode of the plurality of electrodes. The second electrode has a second area. The second fluid droplet has a second volume associated with the second area. The second volume is different from the first volume. The example method also includes forming a combined droplet by selectively activating at least one of the first electrode or the second electrode to cause one of the first fluid droplet or the second fluid droplet to merge with the other of the first fluid droplet or the second fluid droplet.

In some examples, the method includes dispensing a third fluid droplet on a third electrode of the plurality of electrodes. The third fluid droplet is substantially the same as one of the first fluid droplet or the second fluid droplet. In some examples, the method includes selectively activating the first electrode and the third electrode and capturing a portion of the third fluid droplet on the first electrode based on the activation to form the first combined droplet.

In some examples, the second area of the second electrode is a fraction of the first area of the first electrode.

In some examples, the first area of the first electrode and the second area of the second electrode are substantially the same.

In some examples, the method includes activating one or more of the second electrode or a third electrode of the plurality of electrodes to move the second fluid droplet to the third electrode, wherein a third fluid droplet is disposed on the third electrode. The third fluid droplet is different from the second fluid droplet. The second fluid droplet and the third fluid droplet are to form a second combined droplet. In such examples, the method includes activating at least one of the first electrode or the third electrode and merging the second combined droplet with the first fluid droplet on the first electrode to form the first combined droplet. Also, in some examples, the third electrode has a third area different from the second area. The third area is a fraction of the first area. In such examples, the third fluid droplet has a volume different from the volume of the first fluid droplet and the second fluid droplet.

In some examples, the method includes mixing the first combined droplet by activating the first electrode.

In some examples, the method includes calculating a dilution ratio for the first combined droplet based on the first volume and the second volume.

In some examples, the method includes transferring the first combined droplet to an analyzer.

Another example method disclosed herein includes patterning a first electrode on a first substrate, the first electrode having a first area. The example method includes patterning a second electrode on the first substrate. The second electrode has a second area. The second area is a fraction of the first area. The example method also includes associating the first electrode with a first volume based on the first area and a height of a gap between the first substrate and a second substrate. The example method includes associating the second electrode with a second volume based on the second area and the height of the gap, wherein the first electrode and the second electrode are represented in a binary sequence based on the first area and the first volume and the second area and the second respectively.

In some examples, the method includes patterning a third electrode on the first substrate. The third electrode has a third area. The third area a fraction of the first area. Patterning the third electrode includes nesting the second electrode between the third electrode and the first electrode.

In some examples, the method includes patterning a third electrode on the first substrate. The third electrode has a third area. The third area is a fraction of the first area. Patterning the third electrode includes sequentially arranging the first electrode, the second electrode, and third electrode based on a size the first area, a size of the second area, and a size of the third area.

In some examples, the method includes coating the first electrode and the second electrode with at least one of hydrophobic or dielectric material.

In some examples, the method includes creating the first electrode and the second electrode on the first substrate using one or more of a laser or a photolithographic printer.

In some examples, the method includes calculating the binary sequence for a plurality of electrodes with respect to first area of the first electrode.

Also disclosed herein is an example system including an electrode array including a plurality of electrodes including a first electrode and a second electrode, a first sample droplet of a sample to be disposed on the first electrode and a first diluent droplet to be disposed on the second electrode. The first sample droplet has a different volume than the first diluent droplet. The example system also includes a calculator to compute a dilution ratio for the sample. The example system includes an electrical source to selectively activate at least one of the first electrode or the second electrode to combine the sample droplet and the diluent droplet based on the dilution ratio.

In some examples, the electrode array further comprises a third electrode, one of a second sample droplet or a second diluent droplet to be disposed on the third electrode, the one of the second sample droplet or a second diluent droplet having a volume different from the first sample droplet or the first diluent droplet. In such examples, the electrical source is to selectively activate the first electrode and at least one of the second electrode or the third electrode based on the respective volumes.

In some examples, the system includes a dispenser to dispense a diluent onto a third electrode in the electrode array. In some such examples, the electrical source is to activate the second electrode and the third electrode to form the diluent droplet.

Also disclosed herein is an example apparatus including a first substrate and a second substrate. The second substrate is spaced apart from the first substrate. In the example apparatus, an electrode pattern is disposed on the first substrate. The electrode pattern includes a plurality of electrodes including a first electrode having a first area. Each of the other electrodes of the plurality of electrodes has a respective area relative to the first area. Each electrode is represented in binary sequence for the electrode pattern.

Also disclosed herein is an example method including selectively activating a first electrode having a first area, a second electrode having a second area, and a third electrode having a third area. The first area is greater than the second area and the third area and the second area is greater than the third area. A first droplet having a first volume is disposed on the first electrode, a second droplet having a second volume is disposed on the second electrode, and a third droplet having a third volume is disposed on the third electrode. At least one of the first droplet, the second droplet, or the third droplet include a diluent and at least one of the first droplet, the second droplet, or the third droplet include a sample. The selective activation is to cause movement of at least one of the first droplet, the second droplet, or the third droplet relative to the other of the droplets. The example method includes merging, based on the selective activation, the first droplet, the second droplet, and the third droplet to form a combined droplet, wherein the sample of the combined droplet is diluted based on the first volume, the second volume, and the third volume.

In some examples, the sample is diluted by non-integer dilution factor.

In some examples, the method includes dispensing the first droplet on the first electrode by selectively activating the first electrode and a fourth electrode, wherein a fourth droplet having a fourth volume greater than the first volume is disposed on the fourth electrode, a portion of the fourth droplet to be distributed to the first electrode.

In some examples, merging the first droplet, the second droplet, and the third droplet includes moving, via the selective activation, the first droplet proximate to the second electrode. The example method includes partitioning a portion of the second droplet based on the selective activation and combining the first droplet and the portion of the second droplet. In some examples, the method includes moving the first droplet including the portion of the second droplet to the third electrode and partitioning a portion of the third droplet based on the selective activating. In such examples, the method includes combining the portion of the third droplet with the first droplet and the portion of the second droplet to form the combined droplet. Also, in some examples, the method includes returning, via the selective activation, the combined droplet to the first electrode.

An example apparatus disclosed herein includes a first substrate and a second substrate. The second substrate is spaced apart from the first substrate. The example apparatus includes an electrode pattern disposed on the first substrate. The electrode pattern includes a plurality of electrodes including a first electrode having a first area, a second electrode having a first fractional area relative to the first area, and a third electrode having a second fractional area relative to the first area. Each of the first area, the first fractional area, and the second fractional area are different.

In some examples, the first fractional area is one-half of the first area. Also, in some examples, the second fractional area is one-fourth of the first area.

In some examples, the electrode pattern further comprises a fourth electrode having a third fractional area relative to the first area. In some examples, the third fractional area is substantially equal to one of the first fractional area or the second fractional area.

In some examples, the electrode pattern further comprises a fifth electrode having a fourth fractional area relative to the first area.

Also, in some examples, the first area is associated with a first volume of a first droplet disposed on the first electrode, the first fractional area is associated with a second volume of a second droplet disposed on the second electrode, and the second fractional area is associated with a third volume of a third droplet disposed on the third electrode. In such examples, the second and third volumes are fractional volumes relative to the first volume based on the electrode pattern. In some examples, the second volume is substantially equal to one-half of the first volume.

Figure 3A:
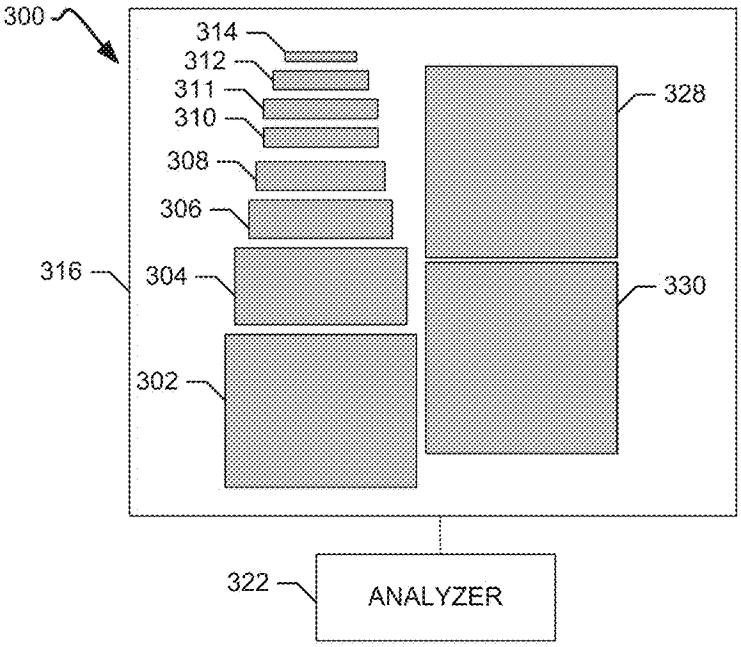
FIG. 3A is a top view of a first example electrode pattern on an example base substrate created via the example methods disclosed herein and coupled to an analyzer.
Figure 3B:
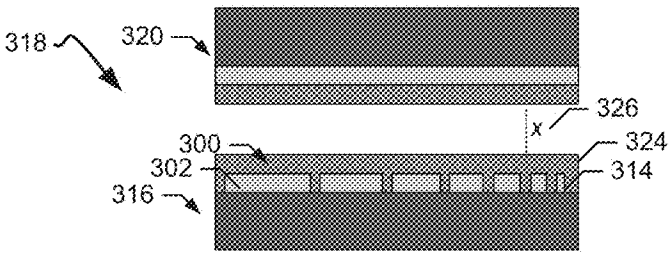
FIG. 3B is a side view of a digital microfluidic chip including the first example electrode pattern of FIG. 3A.

Turning now to the figures, FIG. 3A is a top view of an example electrode array 300 including a first electrode 302, a second electrode 304, a third electrode 306, a fourth electrode 308, a fifth electrode 310, a sixth electrode 311, a seventh electrode 312, and an eighth electrode 314 having relative areas patterned based on a binary sequence on a first or base substrate 316. As will be disclosed below, the fifth electrode 310 and the sixth electrode 311 are substantially the same size. The electrode array 300 can be formed from a conductive material of the base substrate 316. The conductive material can include, for example, gold, silver, copper, or a non-metallic conductor such as a conductive polymer. As shown in FIG. 3B, the electrode array 300 can be part of a digital microfluidic chip 318 that includes the base substrate 316 and a second or top substrate 320.

The electrode array 300 can be used for diluting a sample prior to analysis of the sample by an analyzer 322 (e.g., an immunoassay analyzer). In some examples, the electrode array 300 and the analyzer 322 are disposed within an analytical device, with the electrode array 300 being located in a different portion of the device than the analyzer 322. Such an arrangement allows for the sample to be diluted within certain concentrations in preparation for analysis by the analyzer 322.

The first through eighth electrodes 302, 304, 306, 308, 310, 311, 312, 314 of the electrode array 300 are formed by patterning an electrode design onto the base substrate. Patterning of the first through eighth electrodes 302, 304, 306, 308, 310, 311, 312, 314 can be performed using one more techniques, including, but not limited to lithography, laser ablation (e.g., exposing the base substrate to a laser to form the electrode pattern through broad field blasting of the substrate via the laser or iterative etching of the pattern into the substrate by the laser), inkjet printing, and other methods for creating (e.g., printing) electrodes. The electrode design pattern includes lines and gaps that outline the first through eighth electrodes 302, 304, 306, 308, 310, 311, 312, 314.

After creating the first through eighth electrodes 302, 304, 306, 308, 310, 311, 312, 314, the electrode array 300 is coated with a hydrophobic and/or a dielectric material to form a hydrophobic and/or a dielectric layer 324 as shown in FIG. 3B via, for example, curing of the material. In some examples, the electrode array 300 is formed from a portion of the base substrate 316. For example, the electrode array 300 can be formed using a roll-to-roll assembly such that multiple electrode arrays are formed on the base substrate 316 as the base substrate 316 moves through the assembly. In such examples, after patterning the electrode design and/or depositing the hydrophobic and/or the dielectric material on the electrode array(s) 300, the base substrate 316 is diced into discrete portions, each portion including the electrode array(s) 300. U.S. application Ser. No. 14/687,398 discloses example fabrications of digital microfluidic chips and is hereby incorporated in its entirety.

The respective areas of the first through eighth electrodes 302, 304, 306, 308, 310, 311, 312, 314 are patterned from a binary sequence. As an example, the first through eighth electrodes 302, 304, 306, 308, 310, 311, 312, 314 of the electrode array 300 are created from the binary sequence calculated based on the function $2^n$, where n=0 to 6 is shown in the electrode array 300 of FIG. 3. In the electrode array 300, the first electrode 302 is a standard or unit electrode that is represented by the number "1" in the binary sequence (e.g., $2^0=1$). The first electrode 302 is assigned a relative electrode size of 1. In some examples, the first electrode is proximate to the analyzer 322. As will be further disclosed below (e.g., in connection with FIG. 5), a diluted droplet created using the first through eighth electrodes 302, 304, 306, 308, 310, 311, 312, 314 is moved to the first electrode 302 for transfer to the analyzer 322.

Following the binary sequence, the second electrode 304 is represented by the number "2" in the binary sequence (e.g., $2^1=2$). The second electrode 304 has an electrode size or area of ½ relative to the area of the first electrode 302. Similarly, the third electrode 306 is represented by the number "4" in the binary sequence (e.g., $2^2=4$) and has an electrode size or area of ¼ relative to the first electrode 302. The representation of the fourth through eighth electrodes 308, 310, 311, 312, 314 in the binary continues as disclosed above (e.g., the fourth electrode 308 is represented by the number "8" in the binary sequence and has a relative electrode area of ⅛).

For example, the first or unit electrode 302 can have an area of 1.65 $mm^2$. Following the binary sequence of $2^n$, the second electrode 304 has a surface area of 0.825 $mm^2$ (e.g., ½ of the area of the first electrode 302), the third electrode 306 has a surface area of 0.4125 $mm^2$ (e.g., ¼ of the area of the first electrode 302), the fourth electrode 308 has a surface area of 0.20625 $mm^2$ (e.g., ⅛ of the area of the first electrode 302). Thus, patterning electrodes based on the binary sequence provides for electrodes having surface areas that are a fraction of the unit electrode.

Each of the first through eighth electrodes 302, 304, 306, 308, 310, 311, 312, 314 is assigned a relative volume in accordance with the binary sequence. Thus, a droplet disposed on each of the first through seventh electrodes is considered to have a relative volume of the electrode on which the droplet is deposited. For example, using the binary sequence calculated based on the function $2^n$, where n=0 to 6, the first through seventh electrodes 302, 304, 306, 308, 310, 312, 314 are represented by the numbers 1, 2, 4, 8, 16, 32, and 64 in the sequence, respectively. The first electrode 302 ("1" in the binary sequence) is assigned a relative volume of 64, assuming a constant height x of gap 326 between the base substrate 316 and the second or top substrate 320 of FIG. 3B. The second electrode 304 is assigned a relative volume of 32, the third electrode 306 is assigned a relative volume of 16, and so on, with the seventh electrode 314 being assigned a relative volume of 1. Table 1 below shows the relationship between the representation of the first through seventh electrodes 302, 304, 306, 308, 310, 312, 314 of the example electrode array 300 in the binary sequence and the corresponding relative electrode sizes and the relative volumes.

TABLE 1

Binary Sequence of Example Electrode Array 300

| Electrode of Example Electrode Array 300 | Binary Sequence # | Relative Electrode Size/Area | Relative Volume Associated with Electrode |
|---|---|---|---|
| First Electrode 302 | 1 | 1 | 64 |
| Second Electrode 304 | 2 | ½ | 32 |
| Third Electrode 306 | 4 | ¼ | 16 |
| Fourth Electrode 308 | 8 | ⅛ | 8 |
| Fifth Electrode 310 | 16 | 1/16 | 4 |
| Sixth Electrode 311 | 16 | 1/16 | 4 |
| Seventh Electrode 312 | 32 | 1/32 | 2 |
| Eighth Electrode 314 | 64 | 1/64 | 1 |

As shown in Table 1, the binary sequence provides for a proportional relationship between the respective electrode areas or sizes and the volumes of the first through eighth electrodes 302, 304, 306, 308, 310, 311, 312, 314. Each of the second through eighth electrodes 304, 306, 308, 310, 311, 312, 314 has an area that is a fraction of the area of the first electrode 302. Further, each of the first through eighth electrodes 302, 304, 306, 308, 310, 311, 312, 314 is assigned a relative volume based on its representation in the binary sequence. A droplet disposed on an electrode in the binary sequence can be considered to have a volume that corresponds to the relative volume of the electrode.

The electrode array 300 can include additional or fewer electrodes than the first through eighth electrodes 302, 304, 306, 308, 310, 311, 312, 314. In some examples, the electrode array includes at least two of one or more of respective first through eighth electrodes 302, 304, 306, 308, 310, 311, 312, 314. As illustrated in FIG. 3, the fifth electrode 310 and the sixth electrode 311 are substantially the same size and, thus, have the same areas and corresponding volumes (e.g., the fifth electrode 310 and the sixth electrode 311 each have an area of 1/16 and a relative volume of 4). A sample droplet may be disposed on the fifth electrode 310 and a diluent droplet may be disposed on the sixth electrode 311. As will be disclosed below, such an arrangement provides for the creation of a variety of dilution ratios, as sample droplets and diluent droplets having substantially the same volumes are available for computing the different dilution ratios. Further, the binary sequence is not limited to the example binary sequence described in Table 1. Rather, the relationships between the electrodes in terms of relative areas and, thus, relative volumes, can vary based on a selected binary sequence.

Figure 4:
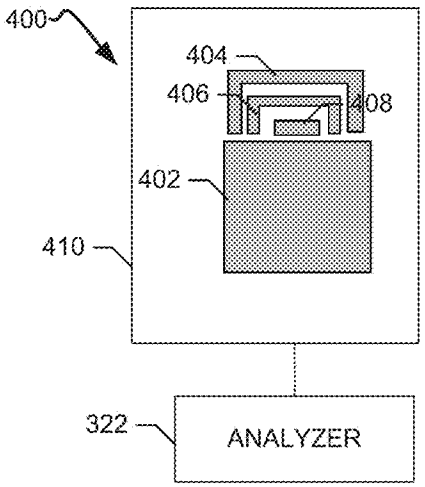
FIG. 4 is a top view of a second example electrode pattern on an example base substrate created via the example methods disclosed herein and coupled to an analyzer.

The arrangement of the first through eighth electrodes 302, 304, 306, 308, 310, 311, 312, 314 of the electrode array 300 is not limited to the arrangement shown in FIG. 3. Rather, a pattern for electrodes of an electrode array can be designed based on one or more factors, including available space on the substrate and/or factors that can affect performance of the digital microfluidic chip, such as spacing between the electrodes. FIG. 4 shows an example electrode array 400 including a first electrode 402, a second electrode 404, a third electrode 406, and a fourth electrode 408. Each of the second through fourth electrodes 404, 406, 408 has an area that is a fraction of the first electrode 402 (e.g., a unit electrode) in accordance with binary sequence for the electrode array 400. As shown in FIG. 4, the first through fourth electrodes 402, 404, 406, 408 are patterned on a base substrate 410 in a nested configuration, such that the second through fourth electrodes 404, 406, 408 at least partially wrap around one or more other ones of the second through fourth electrodes 404, 406, 408. The pattern of FIG. 4 may be used to, for example, conserve space on the base substrate 410 in view of example, a size of the analytical device with which the electrode array 400 and the analyzer 322 are associated. In creating a pattern or design for the electrodes, consideration is given to maintaining the ratios of the areas of the electrodes in accordance with the binary sequence. In addition to the patterns shown in FIGS. 3 and 4, other patterns may also be used including for example, symmetric patterns, asymmetric patterns, irregular patterns, interlocking patterns, repeating patterns and/or any combination of pattern(s), array(s) and/or matrices.

The shapes of the first through eighth electrodes 302, 304, 306, 308, 310, 311, 312, 314 of the electrode array 300 and the first through fourth electrodes 402, 404, 406, 408 of the electrode array 400 are not limited to the shapes shown in FIGS. 3 and 4. Rather, electrode shapes can be designed based on one or more factors, including available space on the substrate and/or factors that can affect performance of the digital microfluidic chip, such as spacing between the electrode s, electrical fields produced by electrode and sizes of droplets manipulated by electrodes, etc. For example, in some examples, one or more electrode(s) may be square shaped, circular, elliptical, triangular, diamond shaped, star shaped, irregularly shaped, shaped to interlock with one or more other electrodes, and/or any other suitable shape or combination of shapes.

In operation, the binary sequence allows for creation of a dilution ratio by selectively combining diluent and sample droplets disposed on each the electrodes of an electrode array. To deposit or distribute diluent and sample droplets on one or more of the first through eighth electrodes 302, 304, 306, 308, 310, 311, 312, 314, one or more reservoir or base electrodes 328, 330 are optionally disposed proximate to the first through eighth electrodes 302, 304, 306, 308, 310, 311, 312, 314. For example, the first reservoir electrode 328 can be covered with a pre-dispensed droplet of sample fluid and the second reservoir electrode 330 can be covered with a pre-dispensed droplet of diluent fluid, the sample and diluent fluids each having a volume that is larger than the volumes of the first through eighth electrodes 302, 304, 306, 308, 310, 311, 312, 314. The one or more larger sample and/or diluent droplets may be dispensed onto the reservoir electrodes 328, 330 via a dispensing device as discussed below in connection with FIG. 7. Also, although in FIG. 3 the first and second base electrodes 330, 328 are shown adjacent to the electrode array 300, the first and second base electrodes 330, 328 can be located elsewhere within an analytical system including the electrode array 300 (e.g., a location other than adjacent to the electrode array 300).

To deposit sample fluid on, for example, the fifth electrode 310, the first reservoir electrode 328 and the fifth electrode 310 are activated such that the sample fluid on the first reservoir electrode 328 is drawn onto to the fifth electrode 310. Deactivating the first reservoir electrode 328 can result in pinching off (e.g. separating, splitting, or portioning) the sample fluid from the first reservoir electrode 328 to the fifth electrode 310. In some examples, depositing sample fluid from the first reservoir electrode 328 to one or more of the first through eighth electrodes 302, 304, 306, 308, 310, 311, 312, 314 includes selectively activating and deactivating the first reservoir electrode 328 and the first through eighth electrodes 302, 304, 306, 308, 310, 311, 312, 314 to draw sample fluid from the first reservoir electrode 328 onto the smaller electrodes and to move the sample fluid droplet(s) to the one or more electrodes 302, 304, 306, 308, 310, 311, 312, 314. In examples where the first reservoir electrode 328 is not located adjacent to the electrode array 300, the sample droplet can be moved (via electrical manipulation) from the location of the first reservoir 328 to the electrode array 300.

Similarly, to deposit or distribute diluent fluid on, for example, the first electrode 302 and the third electrode 306, the first through eighth electrodes 302, 304, 306, 308, 310, 311, 312, 314, are selectively activated and deactivated to draw diluent fluid from the second reservoir 330 and to pinch off or partition diluent to cover the first electrode 302 and the third electrode 306. Diluent fluid can include any liquid capable of serving as a diluting agent, including, for example, reagent diluents. Also, in examples where the second reservoir electrode 330 is not located adjacent to the electrode array 300, the diluent droplet can be moved (via electrical manipulation) from the location of the first reservoir 330 to the electrode array 300.

In some examples, the sample and/or diluent fluid deposited on the first through eighth electrodes 302, 304, 306, 308, 310, 311, 312, 314 has a larger volume (e.g., a slightly larger or an insubstantially larger volume) than the volume associated with the electrodes such that the sample and/or diluent fluid overhangs one or more of the electrodes (e.g., the droplets extend onto adjacent electrodes). As will be described below, such overhanging of droplets can be used to facilitate merging portions of the droplets to form a diluted droplet.

To obtain a dilution ratio of, for example, 20 using the first through eighth electrodes 302, 304, 306, 308, 310, 311, 312, 314 of the electrode array 300 of FIG. 3, a sample droplet is disposed on the fifth electrode 310 having a relative volume of 4 as shown in Table 1. Also, diluent droplets are disposed on the first electrode 302 (having a relative volume of 64), the fourth electrode 308 (having a relative volume of 8), and the sixth electrode 311 (having a relative volume of 4). The diluent droplet disposed on the first electrode 302 is manipulated to collect, combine with, or pick up the sample and diluent fluid disposed on the smaller volume electrodes. To collect the sample and/or diluent droplets or portions thereof disposed on the smaller volume electrodes, the diluent droplet of the first electrode 302 is manipulated or drawn out (e.g., via selective activation of the electrode array 300) to pick up fluids from the respective fourth electrode 308, the fifth electrode 310, and the sixth electrode 311. For example, the diluent droplet of the first electrode 302 moves (e.g., via selective electrical manipulation) to the fourth electrode 308. The diluent droplet of the first electrode 302 and the diluent droplet of the fourth electrode 308 touch such that the smaller volume diluent droplet of the fourth electrode 308 is merged into the larger diluent droplet. In other examples, selective activation of the fourth electrode 308 (and/or other electrodes of the electrode array 300) can result in a portion of the diluent droplet disposed on the fourth electrode 308 being pinched off or partitioned from the remainder of the diluent droplet disposed on the fourth electrode 308. The pinched-off portion can be collected by the diluent droplet of the first electrode 302 (e.g., as a result of the droplets touching). In further examples, the droplet disposed on the fourth electrode 308 moves (e.g., jumps) to an electrode (or between electrodes) for collection by the diluent droplet of the first electrode 302. Also, in some examples, after the sample and/or diluent fluids are pinched off or moved from the fourth, fifth, and sixth electrodes 308, 310, 311 (and/or other electrodes of the electrode array 300) and collected by the diluent droplet of the first electrode 302, a portion of the sample and/or diluent fluid remains on the smaller volume electrodes.

As the original diluent droplet of the first electrode 302 grows from combining the droplet with the other sample and diluent droplets, manipulating the droplet over the electrodes of the electrode array can flood the smaller electrodes (e.g., the volume of the combined droplet is larger than the volume of the smaller electrodes such as the fifth electrode 310). However, collecting the smaller volume sample and diluent droplets via the larger volume diluent droplet of the first electrode 302 prevents a droplet having a small volume (such as a droplet associated with the eighth electrode 314) from being stranded, or unable to join other droplets, due to limitations in manipulating the small-sized droplet to move between electrodes. Flooding the smaller electrodes with a larger volume droplet enables collection of the smaller volume droplets by drawing out the larger volume droplet across one or more electrodes to pick up the smaller volumes. Also, depositing a larger volume (e.g., an insubstantially larger volume) of fluid on a smaller electrode results in the fluid overhanging the electrode (e.g., extending onto an adjacent electrode). The overhang prevents the droplet from being stranded as the droplet can be manipulated, for example, to move to the adjacent electrode or to have a portion pinched off by activation of another electrode in proximity. In examples where droplets or portions of droplets remain on the smaller electrodes after a selected volume is portioned or pinched off, other droplets of sample and/or diluent can be used to clean off the electrodes of the electrode array 300 by collecting the remaining portions substantially as described above with respect to collection of droplets by the diluent droplet of the first electrode 302.

After the smaller volume sample and diluent droplets are collected by the diluent droplet of the first electrode 302, the resulting combined droplet is pulled back (e.g., via selective electrical activation of the electrodes of the electrode array 300) to the first electrode 302. In some examples, the combined droplet has a volume that is larger than the volume associated with the first electrode 302. In such examples, the combined droplet overhangs the first electrode 302 (e.g., extends onto adjacent electrodes such as the second electrode 304). As disclosed above, an overhanging droplet that floods the electrode enables increased manipulation of the droplet as compared to a stranded droplet. The combined droplet can be centered on the first electrode 302 by activating the first electrode 302 and deactivating the other electrodes of the electrode array 300.

The resulting combined droplet includes diluent volumes from the first electrode 302, the fourth electrode 308, and the sixth electrode 311 to obtain a relative diluent volume of 76 (64+8+4). The resulting combined droplet also includes the sample droplet of the fifth electrode 310 having a volume of 4. Therefore, the resulting combined droplet has a dilution ratio of 0.05 (4/(4+76)), or approximately a 20× dilution factor (e.g., 1 part sample, 19 parts diluent). Thus, creating a device with an electrode array comprising electrodes having different areas and associated volumes based on a binary sequence enables the example apparatus, systems and methods disclosed herein to produce or achieve multiple dilution ratios by using different combinations of the electrodes of the electrode array.

Figures 5A, 5B:
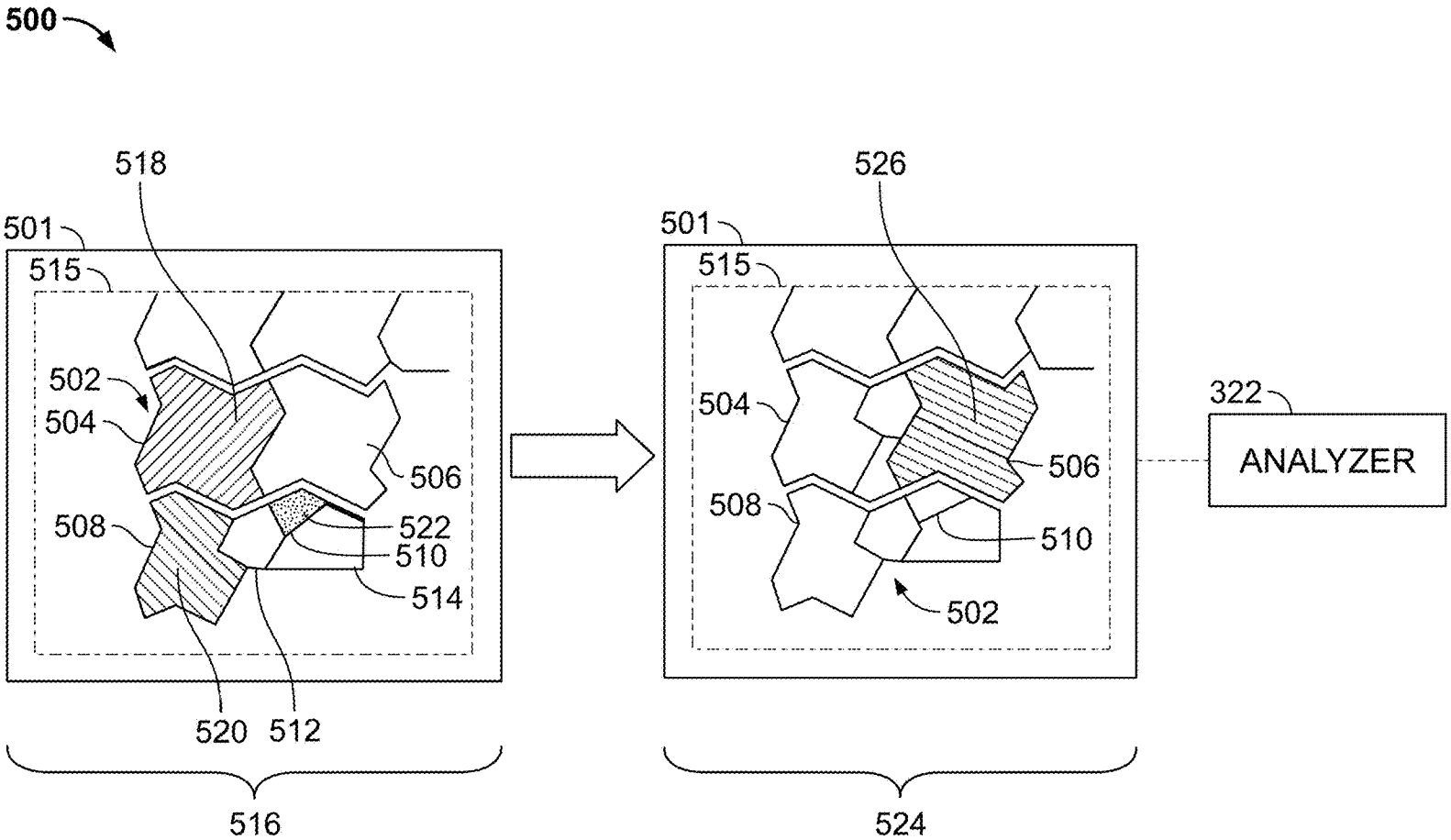
FIG. 5A is a top view of a third example electrode pattern on an example base substrate.
FIG. 5B is a top view of the example base substrate of FIG. 5A coupled to an analyzer as an example dilution process performed using the methods and systems disclosed herein.

FIG. 5A is a top view of a third example electrode pattern on an example base substrate, and FIG. 5B is a top view of the example base substrate of FIG. 5A coupled to an analyzer. Together FIGS. 5A and 5B diagram an example dilution process 500 using electrodes of different sizes created based on a binary sequence. As shown in FIGS. 5A and 5B, a base substrate 501 includes an electrode array 502 having a plurality of electrodes, including a first electrode 504, a second electrode 506, a third electrode 508, and a fourth electrode 510, a fifth electrode 512, and a sixth electrode 514. As an example, the first through sixth electrodes 504, 506, 508, 510, 512, 514 can be represented by a binary sequence (e.g., such as the function $2^n$ as described above in connection with FIG. 3 and Table 1). In the example electrode array 502, the first electrode 504 and the second electrode 506 are unit electrodes such that each of the first electrode 504 and the second electrode 506 are represented by "1" within the binary sequence and have respective relative areas of 1. As also shown in FIGS. 5A and 5B, the third through sixth electrodes 508, 510, 512, 514 have respective areas that are a fraction of the areas of the first electrode 504 and the second electrode 506. As an example, in the electrode array 502, the third electrode 508 has a relative area of ½ and the fourth electrode 510 has a relative area of 1/16 (e.g., corresponding to numbers "2" and "16" in the binary sequence of Table 1). A hydrophobic and/or dielectric material coats the first through sixth electrodes 504, 506, 508, 510, 512, 514 to form a hydrophobic and/or dielectric layer 515.

The dilution process 500 includes a preparation phase 516 (FIG. 5A). As an example, FIG. 5 shows that during the preparation phase 516, a diluent droplet 518 is deposited on the first electrode 504 of the electrode array 502 (e.g., the diluent droplet is disposed on the hydrophobic and/or dielectric layer 515 coating the first electrode 504). The diluent droplet 518 has a relative volume corresponding to a relative volume associated with the first electrode 504 based on the binary sequence (e.g., a relative volume of 64 in the binary sequence of Table 1). Additional diluent droplets may be deposited on one or more of the other electrode(s) of the electrode array 502. In some examples, a diluent droplet is disposed on the unit electrode such that a dilution resulting from the example dilution process 500 includes a relative volume diluent associated with the unit electrode.

Also, in the example electrode array 502, a first sample droplet 520 is deposited on the third electrode 508 (e.g., the first sample droplet 520 is disposed on the hydrophobic and/or dielectric layer 515 coating the third electrode 508) and a second sample droplet 522 is disposed on the fourth electrode 510 (e.g., the second sample droplet 516 is disposed on the hydrophobic and/or dielectric layer 515 coating the fourth electrode 510). The first sample droplet 518 has a relative volume corresponding to the relative volume third electrode 508 based on the binary sequence (e.g., a relative volume of 32 in the binary sequence of Table 1) and the second sample droplet 522 has a relative volume corresponding to the relative volume of the fourth electrode 510 based on the binary sequence (e.g., a relative volume of 4 in the binary sequence of Table 1). Additional and/or fewer sample droplets may be deposited on one or more of the electrode(s) of the electrode array 502.

To deposit the diluent droplet 518, the first sample droplet 520, and the second sample droplet 522 on the respective first, third, and fourth electrodes 504, 508, 510 in preparation for dilution of the samples, digital microfluidic techniques are used to pinch off the droplets 518, 520, 522 from one or more larger sample and/or diluent droplets. The droplets can be deposited onto the electrodes from one or more reservoir electrodes as described in connection with the electrode array 300 of FIG. 3 (e.g., a droplet of diluent is pinched off or portioned from a larger diluent droplet on a reservoir electrode to the first electrode 504 via activation of the first electrode 504 and/or the other electrodes of the electrode array 502). In other examples, as will be described below, the first or second electrodes 504, 506 serve as reservoir electrodes from which the reduced volumes are delivered to the smaller electrodes of the electrode array 502 (e.g., in examples where the reservoir electrodes are not located adjacent to the electrode array 500 and the sample and diluent fluids are moved to the electrode array 500 from elsewhere in the analytical device). The one or more larger sample and/or diluent droplets may be dispensed onto the electrode array 502 via a dispensing device as discussed below in connection with FIG. 7.

For example, to deposit the second sample droplet 522 on the fourth electrode 510 by pinching, a sample droplet having volume greater than the volume associated with the fourth electrode 510 is placed on an electrode of the electrode array 502, such as the second electrode 506. The second electrode 506 and the fourth electrode 510 are energized by applying an electrical potential. In response to the electrical potential, the second electrode 506 holds and/or pulls back the reference sample droplet. At substantially the same time as the second electrode 506 is pulling back the reference sample droplet, the activation of the fourth electrode 510 causes a portion of the reference sample droplet to overlay the fourth electrode 510 such that a portion of the reference sample droplet is pinched off or captured by the fourth electrode 510 to form the second sample droplet 522. In such a manner, the second sample droplet 522 having a relative volume corresponding to a relative volume of the fourth electrode 510 is created. In some examples, the second sample droplet 522 overhangs, or has a larger volume than the fourth electrode 510 to facilitate manipulation of the second sample droplet 522. The above-disclosed pinching or droplet partitioning process can be used to deposit the diluent droplet 518 and/or the first sample droplet 520 in the electrode array 502. Electrical sources provide the electrical potentials to pinch off droplets and such sources are implemented by one or more controllers, as disclosed in connection with FIG. 6.

In the preparation phase 516, diluent and/or sample droplets with known volumes can be created by selectively energizing the electrodes of the electrode array 502 to pinch off portions of one or more droplets having larger volumes. Pinching off droplets provides for reduced volumes of sample and/or diluent fluids to be deposited at certain electrodes of the electrode array 502 (e.g., the first, third, and fourth electrodes 504, 508, 510). The electrodes are selectively energized to deposit droplets on the electrodes of the electrode array 502 that are to be used to achieve a predetermined dilution ratio based on the associated relative volumes of the electrodes in view of the binary sequence.

The example dilution process 500 also includes a dilution phase 524 (FIG. 5B), in which the first and second sample droplets 520, 522 are diluted with the diluent droplet 518 to form a diluted droplet 526. To form the diluted droplet 526, the first and second sample droplets 520, 522 are combined with the diluent droplet 518. In the dilution phase 526 of the example dilution process 500, the sample and diluent droplets 518, 520, 522 are combined by selectively activating the first through sixth electrodes 504, 506, 508, 510, 512, 514 of the electrode array 502 to merge and mix the droplets. For example, the first electrode 504, the third electrode 508, the fourth electrode 510, and the fifth electrode 512 are activated to cause the diluent droplet 518 of the first electrode 504 to move over and/or proximate to the third, fourth, and fifth electrodes 508, 510, 512. For example, the diluent droplet 518 moves onto one or more of the third or fourth electrodes 508, 510 and collects all or substantially all of the first and/or second sample droplets 520, 522 (e.g., via the droplets touching). In other examples, electrical manipulation of the diluent droplet 518 and the sample droplets 520, 522 on the third and fourth electrodes 508, 510 via activation of one or more of the electrodes 504, 508, 510, 512 causes the sample fluid of the first and second sample droplets 520, 522 to be pinched off (e.g., segmented from the remainder of the droplets). The pinched-off sample fluid is merged with or collected by the diluent droplet 518 (e.g., via the droplets touching). Electrical manipulation of the diluent droplet 518 and the first and second sample droplets 520, 522 changes the surface tension properties of the droplets 518, 520, 522 disposed on the hydrophobic and/or dielectric layer 515 of the electrode array 502, thus merging the droplets, and provides for the movement of the droplets (e.g., the diluent droplet 518) within the electrode array 502. In such a manner, the diluent droplet 518 picks up sample fluid from the first and second sample droplets 520, 522 to build the diluted droplet 526. Any remaining portions of sample fluid on the third and fourth electrodes 508, 510 can be removed by collecting the remaining portions via another sample and/or diluent droplet.

The diluent droplet 514 and the first and second sample droplets can be merged within the electrode array in a different manner than disclosed above. In some examples, the first and second sample droplets 520, 522 can be merged together to form a combined sample droplet (e.g., by selectively applying electrode potentials to one or more of the third electrode 508, the fourth electrode 510, or the fifth electrode 512 to move the second sample droplet 522 from the fourth electrode 510 to the third electrode 508). The combined sample droplet can be picked up by one or more diluent droplets during the dilution phase 524. In other examples, two or more diluent droplets disposed on one or more of the first through sixth electrodes 504, 506, 508, 510, 512, 514 are merged via selective electrode activation to form a combined diluent droplet to which one or more sample droplets are added.

Selective activation of the electrodes to pinch off portions of a sample and/or diluent fluid during the preparation phase 516 and to move the sample and/or diluent droplets to form the diluent droplet 526 during the dilution phase 524 can be implemented, for example, via one more predetermined algorithms. The algorithm(s) can indicate which electrodes should be activated in view of, for example, locations of the droplets within the electrode array 502, desired dilution ratios, protocols for combining the droplets (e.g., whether all sample droplet volumes are merged together first before being picked up by a diluent droplet), etc. The algorithms can be implemented by one or more controllers, as disclosed in connection with FIG. 6.

In the example dilution process 500, as the sample and/or diluent droplets are moved within the electrode array 502 and picked up by other sample and/or diluent droplets, the sample fluid and diluent fluid of the droplets mix. For example, when the diluent droplet 518 picks up the first sample droplet 520, the sample fluid of the first sample droplet 520 is mixed with the diluent fluid of the diluent droplet 518. Further mixing of the diluent droplet 518 and the first sample droplet 520 can be performed by manipulating the combined diluent droplet 518 and first sample droplet 520 via an electrical potential applied to, for example, the first electrode 504 to substantially evenly mix the sample and droplet fluids.

In the example dilution process 500, the diluent droplet 518, the first sample droplet 520, and the second sample droplet 522 are merged to form the diluted droplet 526. The diluted droplet 526 has a dilution ratio based on the volumes of the sample and diluent droplets 518, 520, 522 in view of the relative volumes associated with the first electrode 504, the third electrode 508, and the fourth electrode 510 based on the binary sequence. For example, referring to Table 1 above, a dilution ratio of 0.33 can be achieved (e.g., sample volume from the second electrode having associated volume of 32 and a diluent volume of 64 from the first electrode provides for a dilution ratio of ((32)/(32+64))=0.33, or a 3× dilution)). As disclosed above in connection with FIG. 3, in examples in which the diluted droplet 526 has a larger volume than the volume associated with the second electrode 506, the diluted droplet 526 overhangs the second electrode 506. To center the diluted droplet 526 on the second electrode 506, the second electrode 506 can be activated and/or the other electrodes of the electrode array 502 can be deactivated. In the dilution phase 524, rather than performing three repetitions of merging and splitting sample and diluent droplets, the diluted droplet 518 and the first and second sample droplets 520, 522 are selectively collected to form the diluted droplet 526.

As shown in FIGS. 5A and 5B, the diluted droplet 526 is moved from the first electrode 504 to the second electrode 506 (e.g., via selective activation of the first electrode 504 and/or the second electrode 506) to position the diluted droplet proximate to the analyzer 322. From the second electrode 506, the diluted droplet 526 is moved to the analyzer 322 for analysis (e.g., via electrical manipulation of the diluted droplet 526 and/or via a collection/dispending device such as a pipette). As a result of the example dilution process 500, the diluted droplet 526 has a sample concentration within the range of analytical sensitivity for analysis by the analyzer 322.

Figure 6:
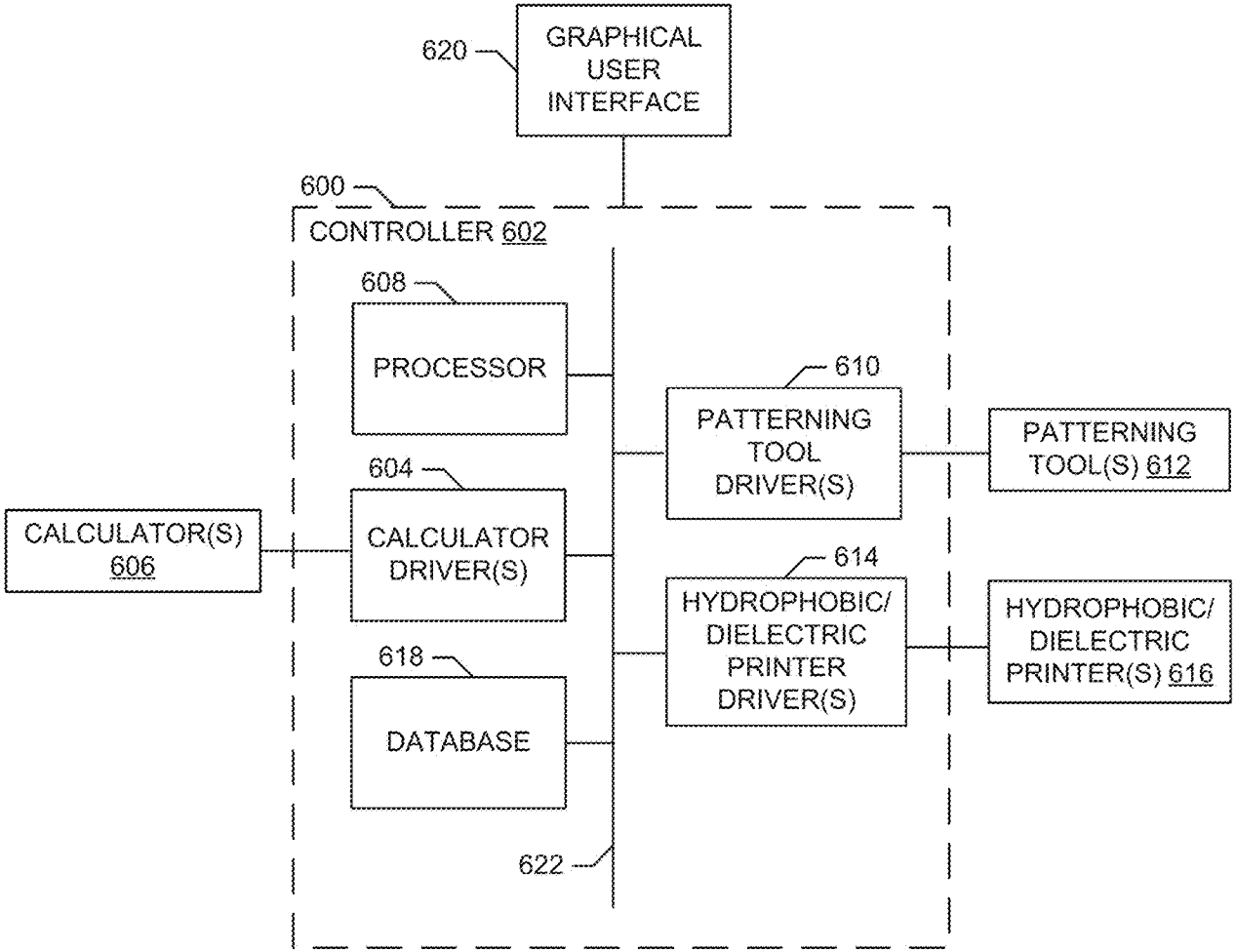
FIG. 6 is a block diagram of an example processing system for patterning electrodes that can be used to implement the examples disclosed herein.

FIG. 6 is a block diagram of an example processing system 600 for patterning electrodes based on a binary sequence. The example processing system 600 includes a controller 602 for controlling tools for patterning electrodes in an electrode array on a substrate (e.g., the base substrate 316, 410, 501 of FIGS. 3, 4, 5A and 5B).

For example, the example processing system 600 includes a calculator driver 604. In some examples, the example processing system 600 includes one or more calculator driver(s) 604. The calculator driver(s) 604 are communicatively coupled to one or more calculator(s) 606. The calculator driver(s) 604 control computations performed by the calculator(s) 606 with respect to a binary sequence derived from a mathematical function for creating a pattern of electrodes in the electrode array on the base substrate (e.g., electrodes of the electrode arrays 300, 400, 502 of FIGS. 3, 4, 5A and 5B). For example, for a given binary sequence, the calculator(s) 606 determine the relative electrode sizes or areas for each electrode to be created in the electrode array. The calculator(s) 606 calculate dimensions of the electrodes based on the relative areas. The calculator(s) 606 also determine the spacing between the electrodes of the electrode array and layout options for the electrodes (e.g., a nested layout as shown in FIG. 4) in view of the relative areas of the electrodes and the available space on a base substrate on which the electrodes are to be created. The calculator driver(s) 604 can also control other calculations related to electrode design pattern characteristics, such as length of lines outlining each electrode as well as the speed at which such calculations are performed by the calculator 606. Also, an example processor 608 operates the calculator driver(s) 604 and, thus, the calculator(s) 606 in accordance with a binary sequence protocol.

The example processing system 600 includes one or more patterning tool driver(s) 610. The patterning tool driver(s) 610 are communicatively coupled to one or more patterning tool(s) 612. The patterning tool(s) 612 pattern one or more electrodes on the base substrate in accordance with the characteristics of the electrode design determined by the calculator(s) 606 in view of the binary sequence. The patterning tool(s) 612 can be, for example, a laser or a photolithographic printer. Other examples of fabrication tools include inkjet printers. The patterning driver(s) 610 control a rate at which the patterning tool(s) 612 print the pattern onto the base substrate, a size of a surface area on the base substrate over which the pattern is formed, and/or how frequently the patterning tool(s) 612 print the pattern on the base substrate as the base substrate moves through, for example, a roller assembly. The patterning tool(s) 612 can print patterns on substrates such as paper or plastics. Also, the example processor 608 operates the patterning tool driver(s) 610 and, thus, the patterning tool(s) 612 in accordance with an electrode patterning protocol.

The example processing system 600 also includes a hydrophobic/dielectric printer driver 614. In some examples, the example processing system includes one or more hydrophobic/dielectric printer drivers 614. In the example shown, the hydrophobic/dielectric printer driver(s) 614 are communicatively coupled to one or more hydrophobic/dielectric printer(s) 616. The hydrophobic/dielectric printer driver(s) 614 control, for example, the thickness, width, and/or pattern of the hydrophobic and/or dielectric material applied to the base substrate by the hydrophobic/dielectric printer(s) 616 to coat the electrodes of the electrode array (e.g., the electrodes of the electrode arrays 300, 400, 501 of FIGS. 3, 4, 5A and 5B). The hydrophobic/dielectric printer driver(s) 614 can also control a rate at which the hydrophobic and/or dielectric material is applied to the substrate. In some examples, the hydrophobic/dielectric printer(s) 616 provides for curing of the hydrophobic and/or dielectric material by application heat and/or ultraviolet light to the substrate to form a hydrophobic and/or dielectric layer (e.g., the hydrophobic and/or dielectric layer 515 of FIGS. 5A and 5B). In such examples, the hydrophobic/dielectric printer driver(s) 614 also control an intensity of the heat and/or ultraviolet light applied to the substrates, the size of an area of the substrates exposed to the heat and/or ultraviolet light, a duration of exposure of the heat and/or ultraviolet light, etc. Also, the example processor 608 operates the hydrophobic/dielectric printer driver(s) 614 and, thus, the hydrophobic/dielectric printers 616 in accordance with a hydrophobic and/or dielectric material application protocol.

The example processing system 600 also includes a database 618 that may store information related to the operation of the example system 600. The information may include, for example, information about the binary sequence (e.g., mathematical functions to create the binary sequence); the relative sizes or areas of the electrodes; the associated relative volumes of the electrodes; the arrangement of the electrodes; the electrode pattern(s) to be created on the substrate via the electrode fabrication (e.g., printing) tools; properties of the hydrophobic, dielectric, and/or other material(s) to be applied to the substrate, etc.

The example processing system 600 also includes a user interface such as, for example, a graphical user interface (GUI) 620. An operator or technician interacts with the processing system 600 via the interface 620 to provide, for example, commands related to operation of the calculator 606, such as the mathematical function, device parameters, desired dilution ratio, and/or analyzer sensitivity value or range used to create the binary sequence and the size of the electrode array; the pattern to be printed on the substrate by the patterning tool(s) 612; the hydrophobic and/or dielectric material to be applied by the hydrophobic and/or dielectric printer(s) 616, etc. The interface 626 may also be used by the operator to obtain information related to the status of any electrode patterning completed and/or in progress, check parameters such as speed and alignment of the electrode patterning process, and/or to perform calibrations.

In the example shown, the processing system components 602, 604, 608, 610, 614, 618 are communicatively coupled to other components of the example processing system 600 via communication links 622. The communication links 622 may be any type of wired connection (e.g., a databus, a USB connection, etc.) and/or any type of wireless communication (e.g., radio frequency, infrared, etc.) using any past, present or future communication protocol (e.g., Bluetooth, USB 2.0, USB 3.0, etc.). Also, the components of the example system 600 may be integrated in one device or distributed over two or more devices.

Figure 7:
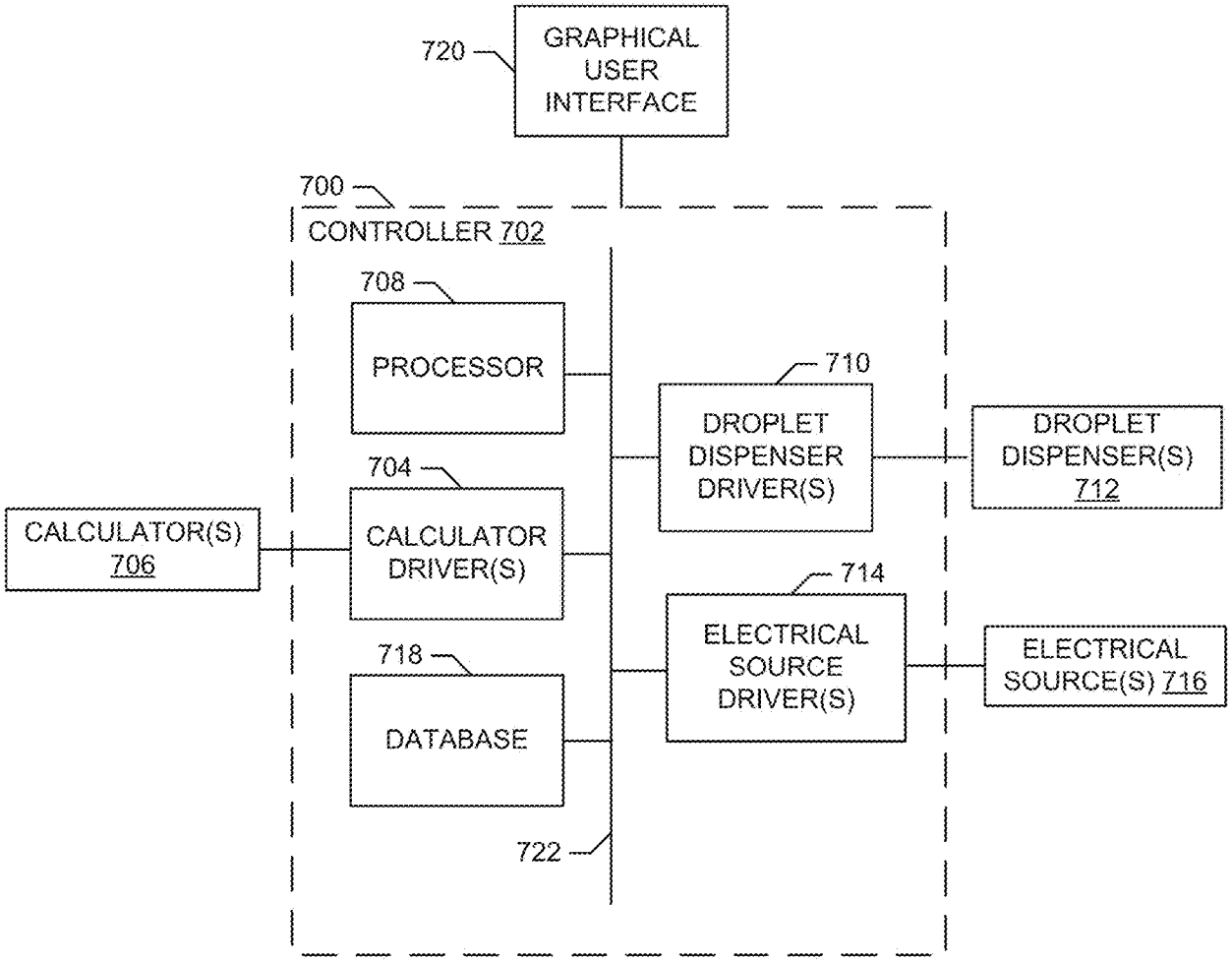
FIG. 7 is a block diagram of an example processing system for performing dilutions that can be used to implement the examples disclosed herein.

FIG. 7 is a block diagram of an example processing system 700 performing dilutions using electrodes of an electrode array patterned based on a binary sequence (e.g., the electrodes of the electrode arrays 300, 400, 502 of FIGS. 3, 4, 5A and 5B). The example processing system 700 includes a controller 702 for controlling tools for performing dilutions.

For example, the example processing system 700 includes a calculator driver 704. The example processing system 700 may include one or more calculator driver(s) 704. The calculator driver(s) 704 are communicatively coupled to one or more calculator(s) 706. The calculator driver(s) 704 control the computation of one or more algorithms by the calculator(s) 706 that is used to determine which electrodes in the electrode array to selectively activate to deposit or pinch off volumes of sample and diluent droplets based on a predetermined dilution ratio. The calculator(s) 706 can also compute the algorithms to determine which electrodes to selectively activate to move the sample and diluent droplets within the electrode array to form a diluted droplet (e.g., the diluted droplet 526 of FIG. 5B). The calculator driver(s) 704 also control the speed at which such calculations are performed by the calculator 706. Also, an example processor 708 operates the calculator driver(s) 704 and, thus, the calculator(s) 706 in accordance with a sample dilution calculation protocol.

The example processing system 700 includes a droplet dispenser driver 710. In some examples, the example processing system 700 includes one or more droplet dispenser drivers 710. The droplet dispenser driver(s) 710 are communicatively coupled to one or more droplet dispenser(s) 712. The droplet dispenser(s) 712 dispense a droplet of sample fluid and/or a diluent onto one or more electrodes of the electrode array, such as one or more reservoir or base electrodes and/or other electrodes of the array, in preparation for performing the dilution process (e.g., during the preparation phase 516 of FIG. 5B). Selective portions of the sample and/or diluent droplets dispensed by the droplet dispenser(s) 712 can be pinched off to form sample and/or diluent droplets having smaller volumes based on the relative volumes associated with the electrodes created by the patterning tool(s) 612 of FIG. 6 (e.g., the diluent droplet 518 and the first and second sample droplet 520, 522 of FIGS. 5A and 5B). The droplet dispenser driver(s) 710 control a size of the droplet(s) dispensed, a number of droplet(s) dispensed, which electrodes within the electrode array receive the droplet(s), etc.

In some examples, the droplet dispenser driver(s) 710 work in association with the calculator driver(s) 704 to selectively dispense a droplet on one or more electrodes based on electrodes that will be used during the dilution process (e.g., the droplet dispenser(s) 712 dispense a droplet on an electrode proximate to an electrode having an associated relative volume that will be used to create a predetermined dilution ratio to increase efficiency in the pinching-off process). Also, the example processor 708 operates the droplet dispenser driver(s) 710 and, thus, the droplet dispenser(s) 712 in accordance with a droplet dispensing protocol.

The example processing system 700 also includes an electrical source driver 714. In some examples, the example processing system 600 includes one or more electrical source driver(s) 714. The electrical source driver(s) 714 are communicatively coupled to one or more electrical sources 716. The electrical source(s) 716 provide electrical potentials to activate the electrodes of the electrode array. The electrical source(s) 716 can be, for example, a voltage source. The electrical source driver(s) 714 control, for example, which electrodes are activated and a duration for which the electrical source is applied to the electrodes to move and/or mix the droplets.

In some examples, the electrical source driver(s) 714 work in association with the calculator driver(s) 704 to selectively apply electrical potentials to one or more electrodes to pinch off portion(s) of a sample and/or fluid droplet to create sample and/or fluid droplets (e.g., the diluent droplet 518 and the first and second sample droplet 520, 522 of FIGS. 5A and 5B) having reduced volumes based on electrodes identified by the calculator(s) 706 as being associated with relative volumes that will be used to create a dilution ratio. Also, in some examples, the electrical source driver(s) 714 work in association with the calculator driver(s) 704 to selectively apply electrical potentials to one or more electrodes to move or capture the reduced volume sample and/or diluent droplets during the dilution phase (e.g., the dilution phase 524 of FIG. 5B) to create a diluted droplet (e.g., the diluted droplet 526). The electrical source driver(s) control the selective activation of one or more electrodes in accordance with the algorithm(s) computed by the calculator(s) 706 to achieve the predetermined dilution ratio. Also, the example processor 708 operates the electrical source driver(s) 714 and, thus, the electrical source(s) 716 in accordance with an electrode activation protocol.

The example processing system 700 also includes a database 718 that may store information related to the operation of the example system 700. The information may include, for example, the relative volumes of the electrodes; the amount of sample and/or diluent fluid dispensed by the droplet dispenser 712; the combinations of relative volumes to obtain dilution ratios; algorithms for determining the selective application of electrical potentials by the electrical source(s) 716 to electrodes associated with respective relative volumes to achieve the dilution ratios; etc.

The example processing system 700 also includes a user interface such as, for example, a graphical user interface (GUI) 720. An operator or technician interacts with the processing system 700 via the interface 720 to provide, for example, commands related to the calculation of a dilution ratio by the calculator 706; the dispensing of a sample and/or a diluent droplet during the preparation phase for pinching off by the droplet dispenser(s) 712; the capturing and/or moving pinched-off portions via activation of the electrical source(s) 716 to create a diluted droplet; etc. The interface 720 may also be used by the operator to obtain information related to the status of any dilution process completed and/or in progress and/or to perform calibrations.

In the example shown, the processing system components 702, 704, 708, 710, 714, 718 are communicatively coupled to other components of the example processing system 700 via communication links 722. The communication links 722 may be any type of wired connection (e.g., a databus, a USB connection, etc.) and/or any type of wireless communication (e.g., radio frequency, infrared, etc.) using any past, present or future communication protocol (e.g., Bluetooth, USB 2.0, USB 3.0, etc.). Also, the components of the example system 700 may be integrated in one device or distributed over two or more devices.

While an example manner of implementing the electrode creation and dilution processes associated of FIGS. 3, 4, 5A, and 5B are illustrated in FIGS. 6 and 7, one or more of the elements, processes and/or devices illustrated in FIGS. 6 and 7 may be combined, divided, re-arranged, omitted, eliminated and/or implemented in any other way. Further, the example controllers 602, 702; the example calculator driver(s) 604, 704; the example calculator(s) 606, 706; the example processors 608, 708; the example patterning tool driver(s) 610; the example patterning tool(s) 612; the example hydrophobic printer driver(s) 614; the hydrophobic printer(s) 616; the example droplet dispenser driver(s) 710; the example droplet dispenser(s) 712; the example electrical source driver(s) 714; the example electrical source(s) 716; the example databases 618, 718; and/or, more generally, the example processing systems 600, 700 of FIGS. 6 and 7 may be implemented by hardware, software, firmware and/or any combination of hardware, software and/or firmware. Thus, for example, any of the example controllers 602, 702; the example calculator driver(s) 604, 704; the example calculator(s) 606, 706; the example processors 608, 708; the example patterning tool driver(s) 610; the example patterning tool(s) 612; the example hydrophobic printer driver(s) 614; the hydrophobic printer(s) 616; the example droplet dispenser driver(s) 710; the example droplet dispenser(s) 712; the example electrical source driver(s) 714; the example electrical source(s) 716; the example databases 618, 718; and/or, more generally, the example processing systems 600, 700 of FIGS. 6 and 7 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example controllers 602, 702; the example calculator driver(s) 604, 704; the example calculator(s) 606, 706; the example processors 608, 708; the example patterning tool driver(s) 610; the example hydrophobic printer driver(s) 614; the example droplet dispenser driver(s) 710; the example electrical source driver(s) 714; the example databases 618, 718; and/or, more generally, the example processing systems 600, 700 of FIGS. 6 and 7 is/are hereby expressly defined to include a tangible computer readable storage device or storage disk such as a memory, a digital versatile disk (DVD), a compact disk (CD), a Blu-ray disk, etc. storing the software and/or firmware. Further still, the example processing systems 600, 700 of FIGS. 6 and 7 may include one or more elements, processes and/or devices in addition to, or instead of, those illustrated in FIGS. 6 and 7, and/or may include more than one of any or all of the illustrated elements, processes and devices.

Figure 8:
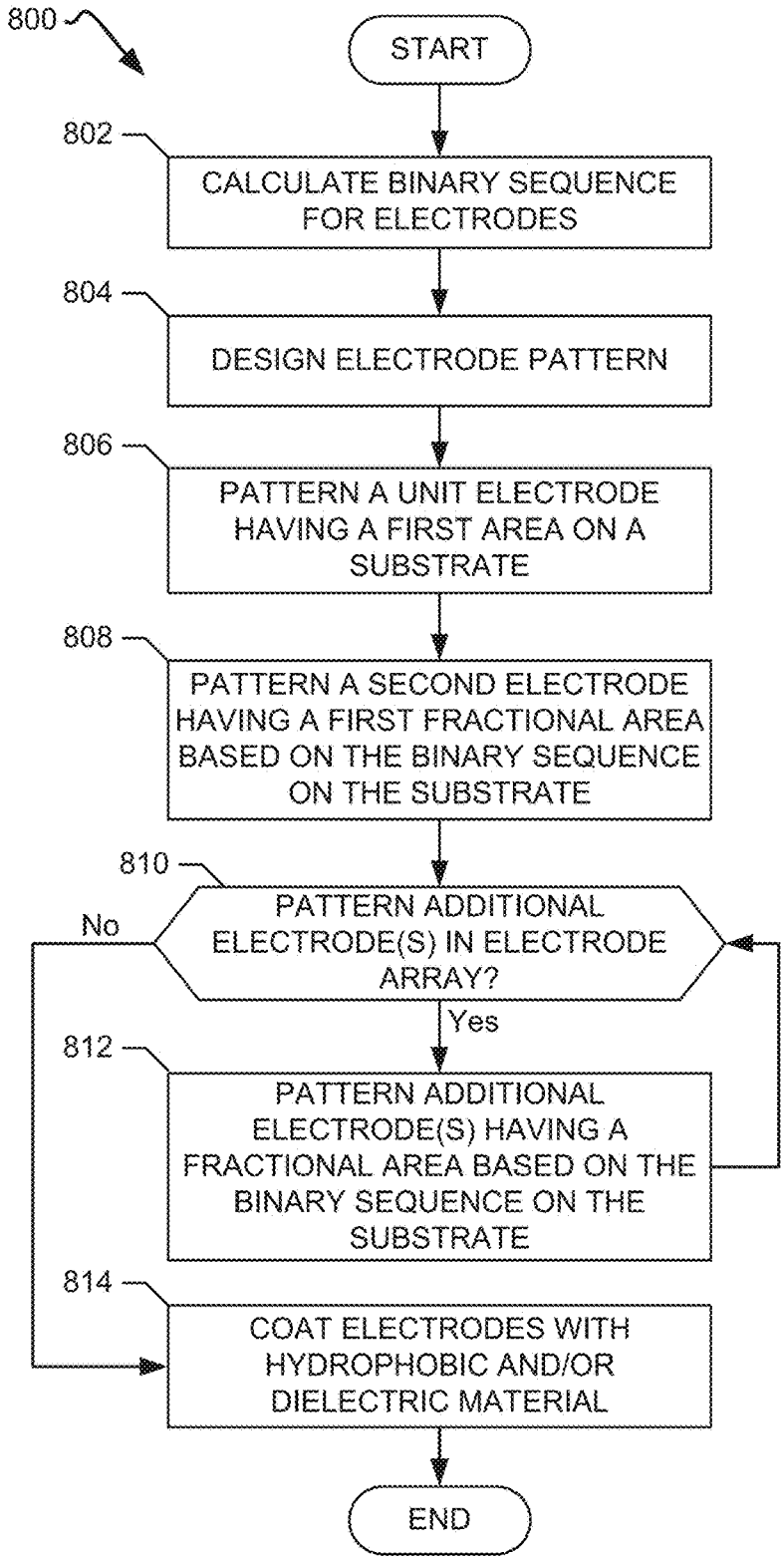
FIG. 8 is a flow diagram of an example method for creating an electrode pattern that can be used to implement the examples disclosed herein.
Figure 9:
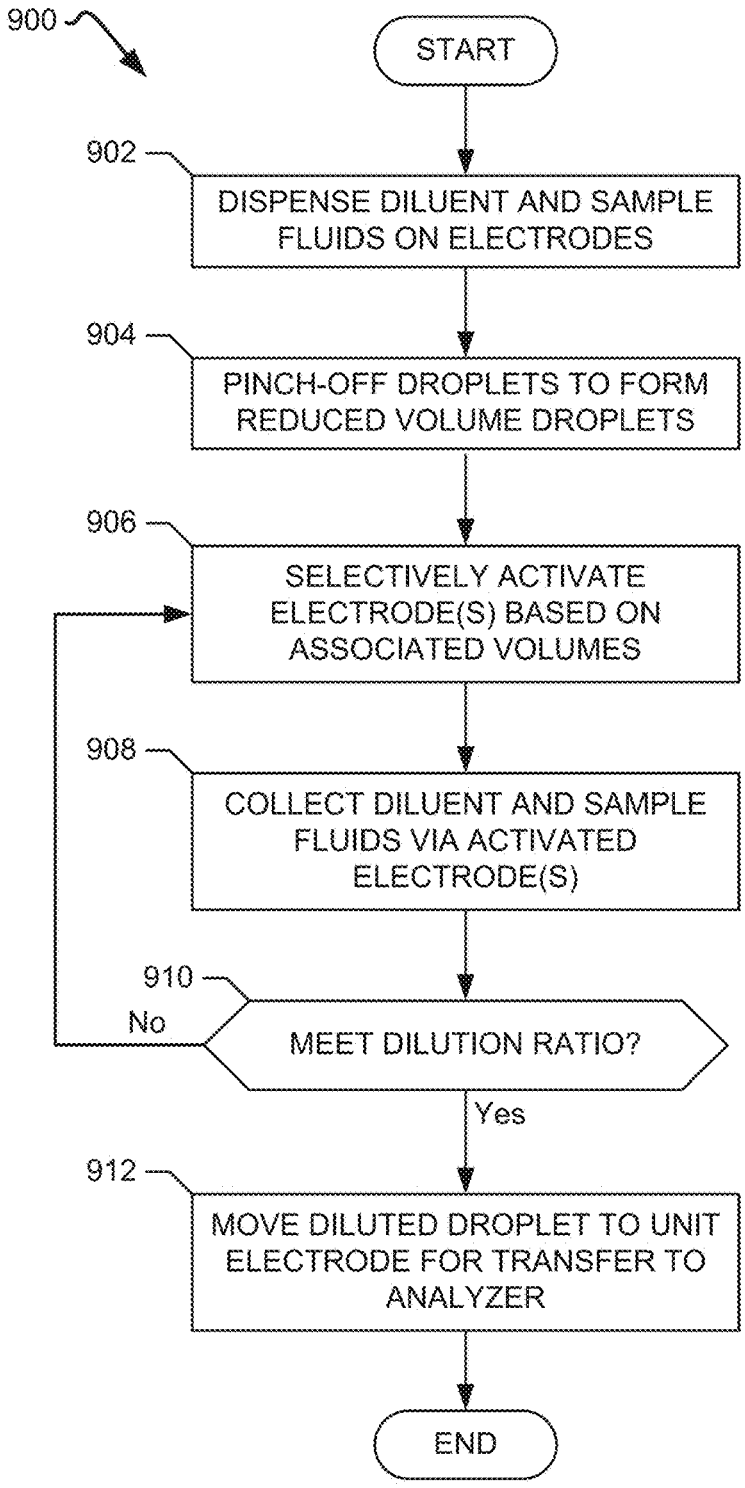
FIG. 9 is a flow diagram of an example method for diluting a sample that can be used to implement the examples disclosed herein.

A flowchart representative of example machine readable instructions for implementing the example processing system 600 of FIG. 6 is shown in FIG. 8. A flowchart representative of example machine readable instructions for implementing the example processing system 700 of FIG. 7 is shown in FIG. 9. In these examples, the machine readable instructions comprise a program for execution by a processor such as the processor 1012 shown in the example processor platform 1000 discussed below in connection with FIG. 10. The program may be embodied in software stored on a tangible computer readable storage medium such as a CD-ROM, a floppy disk, a hard drive, a digital versatile disk (DVD), a Blu-ray disk, or a memory associated with the processor 1012, but the entire program and/or parts thereof could alternatively be executed by a device other than the processor 1012 and/or embodied in firmware or dedicated hardware. Further, although the example program is described with reference to the flowcharts illustrated in FIGS. 8 and 9, many other methods of implementing the example processing systems 600 and 700 may alternatively be used. For example, the order of execution of the blocks may be changed, and/or some of the blocks described may be changed, eliminated, or combined.

As mentioned above, the example processes of FIGS. 8 and 9 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 8 and 9 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

FIG. 8 depicts an example flow diagram representative of an example method 800 for creating an electrode pattern on a substrate based on a binary sequence. The example method 800 includes calculating a binary sequence for creating electrodes having a relative area that is a fraction of a unit electrode (block 802). Each electrode to be created via the example method 800 is represented by a number in the binary sequence. Calculating the binary sequence at block 802 includes determining a number of electrodes to be formed based on the sequence and determining a relative area for each of the electrodes and an associated volume based on the representation of the electrode in the sequence. In some examples, the binary sequence is calculated by the calculator 606 of FIG. 6. The calculator 606 may be controlled by the calculator driver(s) 604 of FIG. 6.

The example method 800 includes designing an electrode pattern (block 804). As disclosed above, the electrodes of the binary sequence have relative areas based on an area of a unit electrode (e.g., the first and second electrodes 504, 506 of FIGS. 5A and 5B). The electrodes may be selectively arranged within an electrode array based on one or more factors such a size and area available within the analytical device for a digital microfluidic chip to be used for sample dilutions and the number of electrodes to be created. Electrode patterns can be designed in an open approach, for example, as shown in the example electrode array 300 of FIG. 3, or a nested approach, as shown in the example electrode array 400 of FIG. 4. Other electrode pattern can be designed to arrange the electrodes within the electrode array in view of the areas of each electrode based on the binary sequence. In some examples, the electrode pattern can be designed using one or more of the calculator(s) 606 and/or the patterning tool(s) 612 of FIG. 6. The patterning tool(s) 612 may be controlled by the patterning tool driver(s) 610 of FIG. 6.

The example method 800 continues at block 806 with patterning a unit electrode having a first area on a substrate (e.g., the base substrates 316, 410, 501 of FIGS. 3, 4, 5A and 5B). In the example method 800, the unit electrode can be represented by the number "1" in the binary sequence (e.g., the binary sequence of Table 1). The area of the unit electrode is used as a reference area for other electrodes created in the pattern. The unit electrode can be patterned on the substrate using one or more techniques including photolithography and/or laser ablation. In some examples, the unit electrode is patterned on the substrate using the patterning tool(s) 612.

In the example method 800, a second electrode having an area that is a fraction of the area of the unit electrode is patterned on the substrate (block 808). The second electrode can be, for example, the electrode that is represented by the next number in the binary sequence (e.g., the second electrode 304 of FIG. 3, represented by the number "2" in the binary sequence of Table 1 and having an area of half of the area of the first electrode 302). In the example method 800, the second electrode is patterned on the substrate in accordance with the electrode pattern designed at block 804, which determines the location of the second electrode within the electrode array. In some examples, the second electrode is patterned on the substrate using the patterning tool(s) 612.

The example method 800 includes a decision whether to pattern additional electrodes on the substrate (block 810). A predetermined number of electrodes may be represented by the binary sequence in view of, for example, a size of the electrode array, the arrangement of the electrode pattern, and a range of dilution ratios to be generated based on the relative volumes associated with the electrodes. If the number of electrodes of the binary sequence to be created based the electrode pattern have been formed on the substrate, the example method 800 continues to block 814, where a hydrophobic and/or a dielectric material is applied to coat the electrodes of the electrode array to form a hydrophobic and/or a dielectric layer (e.g., the hydrophobic and/or dielectric layer 515 of FIGS. 5A and 5B). In some examples, the hydrophobic and/or dielectric material is applied by the hydrophobic and/or dielectric printer(s) 616 of FIG. 6. The hydrophobic and/or dielectric printer(s) 616 may be controlled by the hydrophobic and/or dielectric printer driver(s) 614 of FIG. 6.

If additional electrodes are to be formed on the substrate, the example method 800 continues to block 812, where an additional electrode having an area that is a fraction of the area of the unit electrode is created. For example, a first additional electrode patterned at block 812 could be a third electrode having a second fractional area. In some examples, the areas of the second electrode created at block 808 and the additional electrode (e.g., the third electrode) created at block 814 are different (e.g., the third electrode is represented by a different number in the binary sequence, and, thus, has a different relative area than the second electrode). In other examples, the respective areas of the second electrode and the additional electrode is substantially the same. For example, an electrode pattern designed at block 804 can include one or more electrodes having the substantially the same relative area (e.g., represented by the same number in the binary sequence) to allow for multiple droplets of sample fluids and/or diluents deposited on the electrodes having substantially the same relative volumes, thus increasing the range of dilution ratios that may be achieved using the electrodes. In the example method 800, the additional (e.g. third) electrode is patterned on the substrate at block 812 in accordance with the electrode pattern designed at block 804, which determines the location of the additional electrode within the electrode array. In some examples, the additional electrode is patterned on the substrate using the patterning tool(s) 612.

After the additional (e.g., third) electrode is patterned (block 812), the example method 800 again determines if additional electrodes are to be patterned (bock 810). If a second additional electrode is to be patterned (e.g., a fourth electrode), the example method 800 continues at block 812 and patterns such electrode as detailed above. Also, as detailed above, once there are no more electrodes to pattern (block 810), coatings are added (block 814), and the example method 800 ends.

The example method 800 provides for creating electrodes having areas that are a fraction of a unit or standard electrode and that can be represented in a binary sequence. The example method 800 allows for flexibility in designing an electrode pattern in view of the relative areas of the electrodes. Further, the example method 800 allows multiple electrodes to be formed having different areas or substantially the same areas. Such flexibility in electrode patterning provides for an electrode array that can be used to generate a range of dilution ratios using sample and diluent droplets having volumes associated with the electrodes that are calculated based on a predetermined binary sequence.

FIG. 9 depicts an example flow diagram representative of an example method 900 for diluting a sample. The example method 900 for diluting the sample can be implemented in connection with the electrodes of the electrode arrays formed based on the example method 800 of FIG. 8. In particular, the example method 900 can employ electrodes created based on a binary sequence to generate a dilution profile.

The example method 900 includes dispensing one or more droplets of diluent and one or more droplets of sample fluid on one or more electrodes of the electrode array (e.g., the electrodes of the electrode arrays 300, 400, 501 of FIGS. 3, 4, 5A and 5B) (block 902). In some examples, the diluent and/or the sample fluid is dispensed onto a unit electrode (e.g., the unit electrodes 302, 402, 504, 506 of FIGS. 3, 4, 5A and 5B) and/or a reservoir electrode (e.g., the reservoir electrodes 328, 330 of FIG. 3). The droplets of diluent and sample fluids can be dispensed by the droplet dispensing device(s) 612 of FIG. 6. The droplet dispensing device(s) 612 are controlled by the droplet dispensing driver(s) 610 of FIG. 6.

At block 904 the example method 900, portions of the diluent and/or sample droplets dispensed at block 902 are pinched off to form diluent and/or sample droplets having reduced volumes relative to the droplets dispensed at block 902. Pinching off of the droplets to form droplets having reduced volumes can be performed by selectively activating one or more of the electrodes of the electrode array such that an electrode associated with a reduced volume based on the binary sequence (e.g., a binary sequence determined at block 802 of the example method 800) captures a portion of the larger droplet(s). In some examples, the portions deposited on the electrodes have volumes greater than the volumes associated with the electrodes such that the portions overhang the electrodes.

In some examples, the calculator(s) 706 of FIG. 7 determine which electrodes should be selectively activated to receive pinched-off portions of sample and/or diluent fluid based on relative volumes that will be used to obtain a dilution ratio. Also, in some examples, the electrical source(s) 716 provide electrical potentials to selectively activate the electrodes. The calculator(s) 706 is controlled by the calculator driver(s) 704 and the electrical source(s) 716 are controlled by the electrical source driver(s) 714 of FIG. 7.

Pinching off droplets to form reduced volume droplets provides for one or diluent droplets (e.g., the diluent droplet 518 of FIG. 5A) and one or more sample droplets (e.g., the first and/or second sample droplets 520, 522 of FIG. 5A) to be deposited on the selected electrodes in the electrode array. As disclosed above, the electrodes can be represented by a binary sequence and assigned relative areas and relative volumes in view of a standard unit electrode. Thus, the diluent and/or sample droplets deposited on the electrodes have relative volumes that correspond to the relative volumes of the electrodes with which the droplets are associated.

To obtain a dilution ratio using the reduced volume droplets, the example method 900 includes selectively activating electrode(s) based on the relative volumes associated with each electrode (block 906). In some examples, the calculator(s) 706 of FIG. 7 determine which electrodes should be activated, for example, by the electrical source(s) 716 based on one or more algorithms for generating dilution ratios using the relative volumes. In some examples one or more electrode(s) are activated simultaneously. In some examples, two or more electrodes are activated in sequence. In some examples, different electrodes are activated at different times, and in some examples some of the times of activation at least partially overlap.

Selectively activating the electrodes at block 906 also electrically manipulates the droplets disposed on the electrodes by changing, for example, surface tension properties. By electrically manipulating the droplets, the diluent and/or sample droplets can be moved between electrodes of the electrode array. In the example method 900, the diluent and/or sample fluids (e.g., droplets or pinched-off portions) are collected via the activated electrodes (block 908). Collecting the droplets at block 908 can include, for example, moving one or more sample and/or diluent droplets from a first electrode to a second electrode to merge with one or more other sample and/or diluent droplets (e.g., moving the first sample droplet 520 from the third electrode 508 to the first electrode 504 to merge with the diluent droplet 518 as disclosed in connection with FIG. 5A) or pinching off droplets to merge diluent and/or sample fluids. In some examples, a plurality of diluent droplets is collected to form a combined diluent droplet that is merged with one or a plurality of sample droplet(s). In other examples, diluent and sample droplets are collected at substantially the same time (e.g., a first diluent droplet may merge with a sample droplet to form a combined sample-diluent droplet, which is then merged with a second diluent droplet). Droplet collection protocols can be determined by, for example, the calculator 706 of FIG. 7.

By collecting and merging the one or more diluent and/or sample droplets within the electrode array, one or more combined droplets including a mixture of diluent and sample fluids is created. The combined droplet(s) have known relative volumes of sample fluid and/or diluent fluid based on the electrodes of the binary sequence from which the droplets where collected. The example method 900 includes a determination of whether relative volumes of sample and diluent droplets have been collected to meet a predetermined dilution ratio (block 910). If the dilution ratio has not yet been obtained, sample and/or diluent droplets are collected via selective activation of electrodes associated with relative volumes that can be used to generate the predetermined dilution ratio.

If the dilution ratio has been obtained, such that the concentration of the sample fluid has been diluted within, for example, a sensitivity range of an analytical device for analyzing the sample, the diluted droplet is moved to a unit electrode of the electrode array (e.g., the unit electrodes 302, 402, 504, 506 of FIGS. 3, 4, 5A and 5B) (block 912). Moving the diluted droplet to the unit electrode positions the droplet for transfer to an analyzer within the analytical device (e.g., the analyzer 322 of FIGS. 3, 4, 5B). In some examples, a sample and/or a diluent droplet is disposed on the unit electrode such that the diluted droplet includes a relative volume of sample and/or diluent associated with the unit electrode. Moving the diluted droplet to the unit electrode for transfer to the analyzer can be performed by applying electrical potentials to one or more of the electrodes of the electrode array via, for example, the electrical source(s) 716 to manipulate the droplet.

Thus, the example method 900 provides for dilution of a sample by building a diluted droplet from one or more diluent droplets and one or more sample droplets having relative volumes based on electrodes created using a binary sequence. Rather than repeatedly merging and splitting droplets of sample and diluent fluids, in the example method 900, sample and diluent droplets are selectively collected to form a diluted droplet that includes volumes of sample and diluent that meet a predetermined dilution ratio. The example method 900 provides for increased precision in generating dilution profiles, as the relative volumes of the sample and diluent droplets are known in view the representation of the electrodes in the binary sequence. The example method 900 provides for a variety of dilution ratios to be obtained by selectively combining droplets from electrodes in the electrode array.

Figure 10:
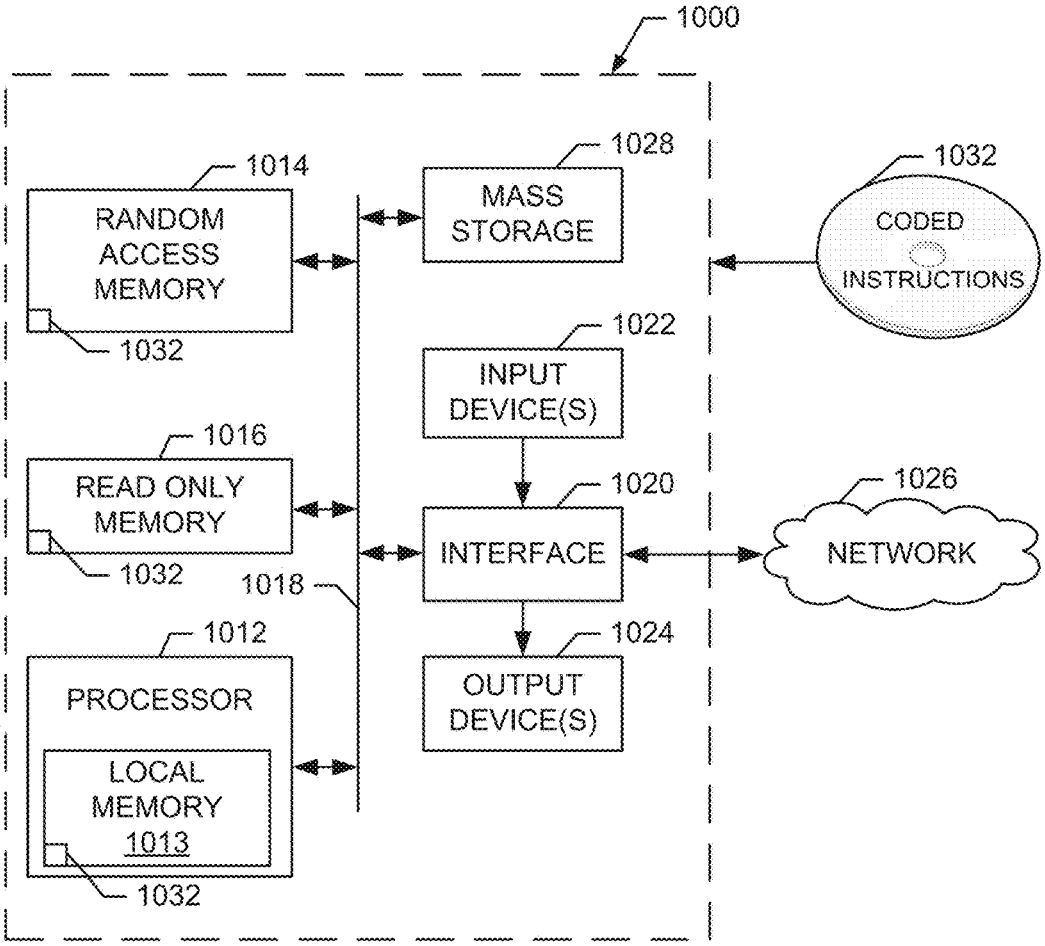
FIG. 10 is a diagram of a processor platform for use with the examples disclosed herein The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts.

FIG. 10 is a block diagram of an example processor platform 1000 capable of executing the instructions of FIGS. 8 and 9 to implement the apparatus of FIGS. 6 and 7. The processor platform 1000 can be, for example, a server, a personal computer, a mobile device (e.g., a cell phone, a smart phone, a tablet such as an iPad™), a personal digital assistant (PDA), an Internet appliance, or any other type of computing device.

The processor platform 1000 of the illustrated example includes a processor 1012. The processor 1012 of the illustrated example is hardware. For example, the processor 1012 can be implemented by one or more integrated circuits, logic circuits, microprocessors or controllers from any desired family or manufacturer.

The processor 1012 of the illustrated example includes a local memory 1013 (e.g., a cache). The processor 1012 of the illustrated example is in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), and/or a PCI express interface.

In the illustrated example, one or more input devices 1022 are connected to the interface circuit 1020. The input device(s) 1022 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 1020 of the illustrated example, thus, typically includes a graphics driver card, a graphics driver chip or a graphics driver processor.

The interface circuit 1020 of the illustrated example also includes a communication device such as a transmitter, a receiver, a transceiver, a modem and/or network interface card to facilitate exchange of data with external machines (e.g., computing devices of any kind) via a network 1026 (e.g., an Ethernet connection, a digital subscriber line (DSL), a telephone line, coaxial cable, a cellular telephone system, etc.).

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, RAID systems, and digital versatile disk (DVD) drives.

The coded instructions 1032 of FIGS. 8 and 9 may be stored in the mass storage device 1028, in the volatile memory 1014, in the non-volatile memory 1016, and/or on a removable tangible computer readable storage medium such as a CD or DVD.

From the foregoing, it will be appreciated that the above disclosed methods, apparatus, and systems provide for dilution of a sample fluid via digital microfluidic techniques that use electrodes of different sizes created based on binary sequence to selectively achieve target sample concentration levels. The electrodes represented by the binary sequence have fractional areas in view of unit or standard electrode. Assuming a constant gap height between, for example, a base substrate on which the electrodes are formed, and a top substrate, each electrode in the binary sequence can be assigned a relative volume based on the fractional areas. The examples disclosed herein provide for electrode arrays containing combinations of electrodes that are associated with different relative volumes and/or substantially the same relative volumes to meet a variety of dilution protocols. Further, the different sized electrodes can be arranged in a variety of layouts to accommodate, for example, space limitations within an analytical device.

Performing dilutions using the differently sized electrodes allows for a range of dilution ratios to be generated by selectively activating electrodes associated with certain relative volumes to merge and mix sample and diluent droplets deposited on the electrodes via electrical manipulation of the droplets. By merging and mixing selective sample and diluent droplets with known relative volumes based on the binary sequence, the example methods and systems disclosed herein provide for flexibility in creating diluted droplets that meet a variety of dilution ratios. Rather than being limited to dilution factors obtained by repeatedly merging and splitting droplets, the examples disclosed herein allow a diluted droplet to be built up from a combination of sample and diluent volumes. The examples disclosed herein provide for efficiency in the dilution process, as one droplet from each electrode is collected to form the diluted droplet. Further, the examples disclosed herein reduce errors during the dilution process by reducing the number of operations performed on the surface of the electrodes and thus, reducing surface tension effects and difficulties in manipulating a large droplet. The examples disclosed herein also provide for precision in dilution processes, as sample and/or diluent volumes are known prior to creating the diluted droplet based on the relative volumes of the electrodes from which the droplets are collected.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

patterning a first electrode on a first substrate, the first electrode having a first area;

patterning a second electrode on the first substrate, the second electrode having a second area, wherein the second area is a first fraction of the first area;

patterning a third electrode on the first substrate, the third electrode having a third area, wherein the third area is a second fraction of the first area;

associating the first electrode with a first volume based on the first area and a height of a gap between the first substrate and a second substrate; and associating the second electrode with a second volume based on the second area and the height of the gap;

associating the third electrode with a third volume based on the third area and the height of the gap, wherein the first electrode, the second electrode, and the third electrode are represented in a binary sequence based on the first area and the first volume, the second area and the second volume, and the third area and the third volume, respectively, and wherein the first electrode, the second electrode, and the third electrode are disposed non-linearly on the first substrate.

2. The method of claim 1, further including coating the first electrode, the second electrode, or the third electrode with at least one of hydrophobic or dielectric material.

3. The method of claim 1, further including patterning the first electrode the second electrode, or the third electrode on the first substrate using one or more of a laser or a photolithographic printer.

4. The method of claim 1, further including calculating the binary sequence for a plurality of electrodes with respect to first area of the first electrode.

5. The method of claim 1, wherein patterning the second electrode further includes printing the second electrode to have an asymmetric shape.

6. The method of claim 1, further including patterning a fourth electrode on the first substrate to interlock with the first electrode.

7. The method of claim 1, further including arranging the first electrode, the second electrode, and the third electrode on the first substrate based on an area of the first substrate.

8. An apparatus comprising:

a first substrate;

a second substrate, the second substrate spaced apart from the first substrate;

an electrode pattern disposed on the first substrate, the electrode pattern including a plurality of electrodes including a first electrode having a first area, a second electrode having a first fractional area relative to the first area, and a third electrode having a second fractional area relative to the first area, each of the first area, the first fractional area, and the second fractional area being different, wherein the first electrode, the second electrode, and the third electrode are disposed non-linearly on the first substrate.

9. The apparatus of claim 8, wherein the first fractional area is one-half of the first area.

10. The apparatus of claim 8, wherein the second fractional area is one-fourth of the first area.

11. The apparatus of claim 8, wherein the electrode pattern further comprises a fourth electrode having a third fractional area relative to the first area.

12. The apparatus of claim 11, wherein the electrode pattern further comprises a fifth electrode having a fourth fractional area relative to the first area.

13. The apparatus of claim 11, wherein the third fractional area is substantially equal to one of the first fractional area or the second fractional area.

14. The apparatus of claim 11, wherein the third fractional area is different than the first fractional area and the second fractional area.

15. The apparatus of claim 8, wherein the first area is associated with a first volume of a first droplet to be disposed on the first electrode, the first fractional area is associated with a second volume of a second droplet to be disposed on the second electrode, and the second fractional area is associated with a third volume of a third droplet to be disposed on the third electrode, the second and third volumes being fractional volumes relative to the first volume based on the electrode pattern.

16. The apparatus of claim 15, wherein the second volume is substantially equal to one-half of the first volume.

* * * * *